US007396218B2

(12) United States Patent
Hyde et al.

(10) Patent No.: US 7,396,218 B2
(45) Date of Patent: Jul. 8, 2008

(54) MICRO IRRIGATION PUMP

(75) Inventors: Robert Brandon Hyde, Kisumu (KE); Abdlikadir Mohammed Musa, Nairobi (KE); Mark Francis Butcher, Sammamish, WA (US); Martin Fisher, San Francisco, CA (US)

(73) Assignee: Kickstart International, Inc., San Francisco, CA (US)

( * ) Notice: Subject to any disclaimer, the term of this patent is extended or adjusted under 35 U.S.C. 154(b) by 525 days.

(21) Appl. No.: 10/479,196

(22) PCT Filed: May 31, 2002

(86) PCT No.: PCT/US02/17518

§ 371 (c)(1),
(2), (4) Date: Apr. 27, 2004

(87) PCT Pub. No.: WO02/097269

PCT Pub. Date: Dec. 5, 2002

(65) Prior Publication Data

US 2004/0166005 A1 Aug. 26, 2004

Related U.S. Application Data

(60) Provisional application No. 60/294,749, filed on May 31, 2001.

(51) Int. Cl.
*F04B 39/10* (2006.01)
*F04B 53/10* (2006.01)

(52) U.S. Cl. ..... 417/534; 417/903

(58) Field of Classification Search ..... 417/903, 417/437, 534, 544
See application file for complete search history.

(56) References Cited

U.S. PATENT DOCUMENTS

| | | | | | |
|---|---|---|---|---|---|
| 523,240 | A | * | 7/1894 | Rodenbaugh | 417/527 |
| 1,539,556 | A | * | 5/1925 | Garber | 417/544 |
| 3,730,651 | A | * | 5/1973 | Ellis | 417/554 |
| 4,173,431 | A | * | 11/1979 | Smith | 417/229 |
| 5,118,265 | A | * | 6/1992 | Bearss | 417/534 |
| 5,363,666 | A | * | 11/1994 | Tieken | 62/129 |
| 5,445,505 | A | * | 8/1995 | Hung | 417/374 |
| 5,634,774 | A | * | 6/1997 | Angel et al. | 417/229 |
| 5,651,302 | A | * | 7/1997 | Mills | 92/117 A |

* cited by examiner

*Primary Examiner*—Devon Kramer
*Assistant Examiner*—Patrick Hamo
(74) *Attorney, Agent, or Firm*—Goodwin Procter LLP

(57) ABSTRACT

An irrigation device (FIG. 1) for pumping fluids, particularly water, which can be constructed for a minimal cost and operated using only human power and having a simple and efficient mechanism making it suitable for use in undeveloped areas. The device includes a handle, contoured footpad, rocker, dual-action piston, outlet valve, and a surge chamber.

13 Claims, 29 Drawing Sheets

MICRO IRRIGATION PUMP

CROSS REFERENCE TO RELATED APPLICATION(S)/CLAIM OF PRIORITY

This application claims the benefit of and incorporates in its entirety herein by reference the contents of the following now abandoned applications: application Ser. No. 60/294,749 filed on May 31, 2001, entitled "Micro Irrigation Pump"

STATEMENT REGARDING FEDERALLY SPONSORED RESEARCH OR DEVELOPMENT

Not applicable.

REFERENCE OF AN APPENDIX

Not applicable.

BACKGROUND OF THE INVENTION

1. Field of the Invention

The present invention relates generally to irrigation devices and more particularly to a novel arrangement for pumping fluids, namely water, at minimal cost using only human power.

2. Brief Description of the Related Art

Generally classifiable as "manual water pumps", prior art approaches include centrifugal, reciprocating and diaphragm pumps. Centrifugal pumps use a rotating turbine to suck and propel water. Reciprocating pumps use a piston in a back-and-forth motion within a cylinder. Diaphragm pumps use the displacement caused by the deformation of a flexible diaphragm to suck and propel water.

Limitations with the prior art pumps include the following: prior art hand-operated pumps use one-cylinder and do not provide a pressure head, or the ability to push water above the position of the pump itself. Hand operation is not as ergonomically efficient as foot operation. However, prior art foot-operated pumps use two cylinders, two pedals/treadles and a number of pivots, thus, increasing their overall cost. Specifically, many require expensive custom-machined or cast components. Furthermore, almost all of the aforementioned prior art pumps have a number of fasteners (bolts, washers, screws, latches, etc.), which commonly rust, rendering them useless over time.

Thus a solution is needed which overcomes the above problems and limitations of the prior art.

SUMMARY OF THE INVENTION

The present invention overcomes the aforementioned problems of the prior art. Specifically, one of several aspects of the present invention is to assist in lifting and pushing water at minimal cost and using only human power.

These and other aspects, features and advantages of the present invention will become better understood with regard to the following description and accompanying drawings.

BRIEF DESCRIPTION OF THE DRAWINGS

Referring briefly to the drawings, embodiments of the present invention will be described with reference to the accompanying drawings in which.

The accompanying Figures illustrate several views of at least one exemplary embodiment of the present invention including certain aspects, features and advantages of the present invention.

DETAILED DESCRIPTION OF THE INVENTION

Figure 1:
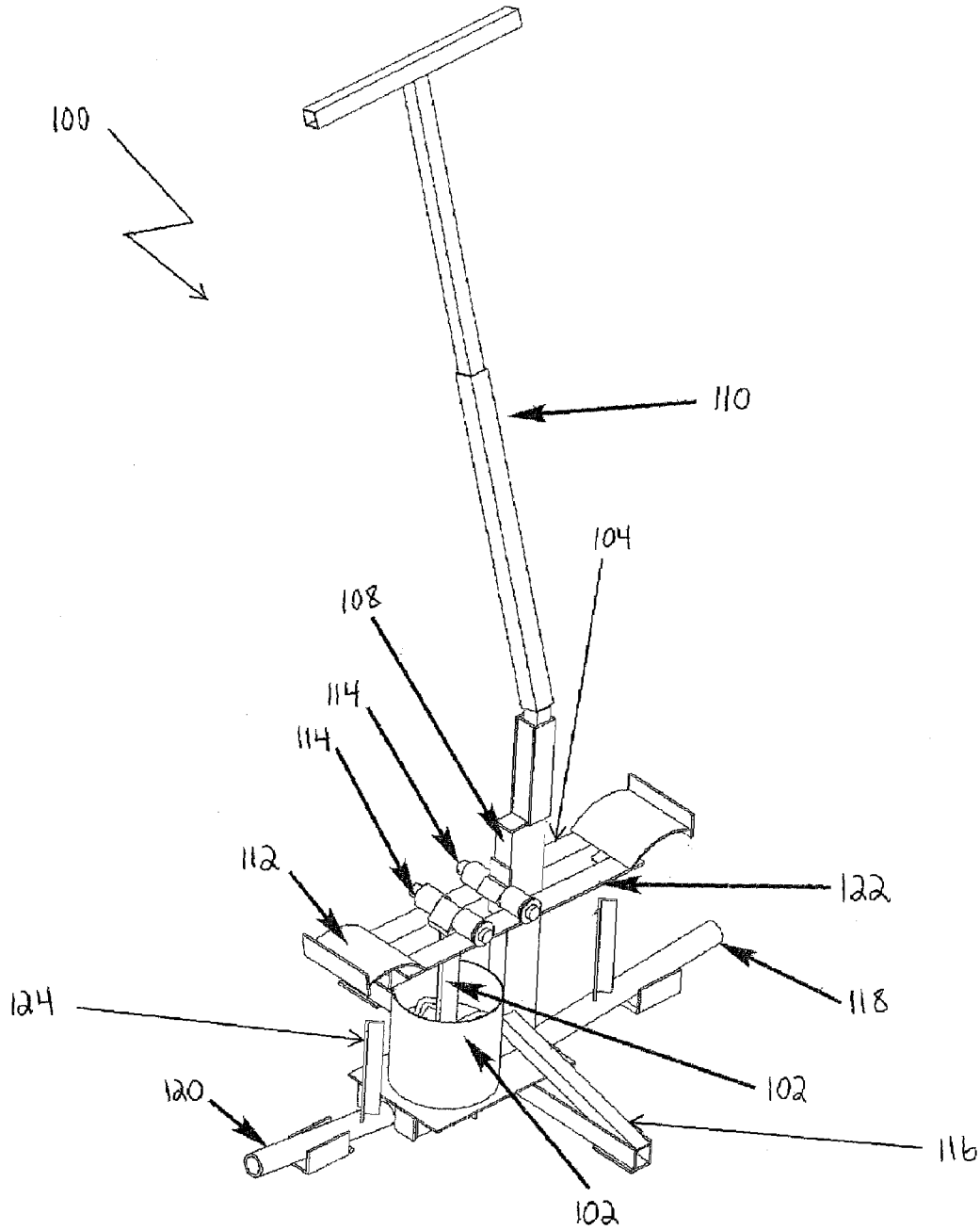
FIG. 1 is an isometric view of the present invention.

Referring more specifically to the drawings, for illustrative purposes the present invention is embodied in the configuration, method of operation and/or article of manufacture, generally shown in the Figures. It will be appreciated that the apparatus, method of operation and/or article of manufacture may vary as to the details of its configuration and operation without departing from the basic concepts disclosed herein. The following description is, therefore, not to be taken in a limiting sense.

Novel features of one embodiment of the subject invention include the following:

Layout or orientation of the pump 100. The present solution comprises one or more dual-action (suction and pressure) cylinders 102 slightly off-center on a transverse see-saw-style rocker 104 with one foot on either end. This allows use of the legs, minimizes the number of pivot points 114 required and allows provision of a pressure head.

An outlet valve 126 design provides quicker and more efficient operation along with a large flow area. Pretensioned by the concave lower valve seal support surface, it ensures quick closing even at low pressure heads. The present solution also allows the user to change the valve seal from the inlet side of the valve, without fasteners, obviating the need to open the valvebox to change the valve seal.

An inlet valve design which allows the present solution to be changed without the use of fasteners, while still providing a large flow area.

Fastenerless construction. Fasteners are not used in the present solution.

The built-in surge chamber 108. This chamber 108, on either or both the suction and pressure side of the pump 100, facilitates smooth water flow.

Portability of the pump. The present solution is portable and completely free-standing.

A multi-position handle 110. A multi-position handle can be placed in any one of multiple positions, allowing the user to find his/her most comfortable position and even to switch when tired. This is all the more important since the ratio of effort needed on each side of the rocker 104 depends on the ratio of the pressure and suction heads.

A contoured footpad 112. The footpad is contoured to allow continuous comfort and maximum pumping efficiency.

For a thorough description of the present invention, reference is now made to the detailed embodiments of the invention illustrated in the accompanying drawings.

Figure 2:
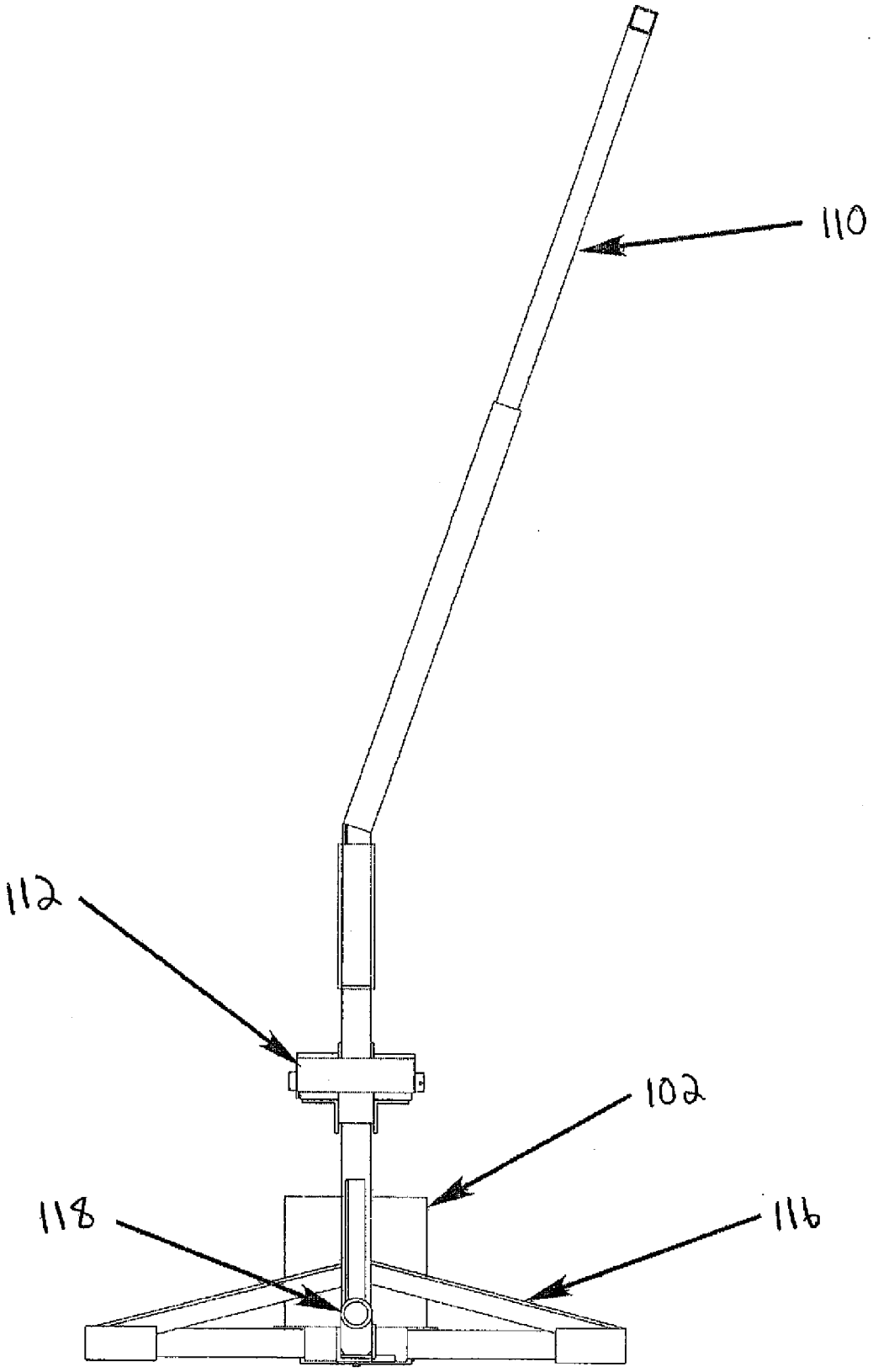
FIG. 2 is a side view of the present invention.
Figure 3:
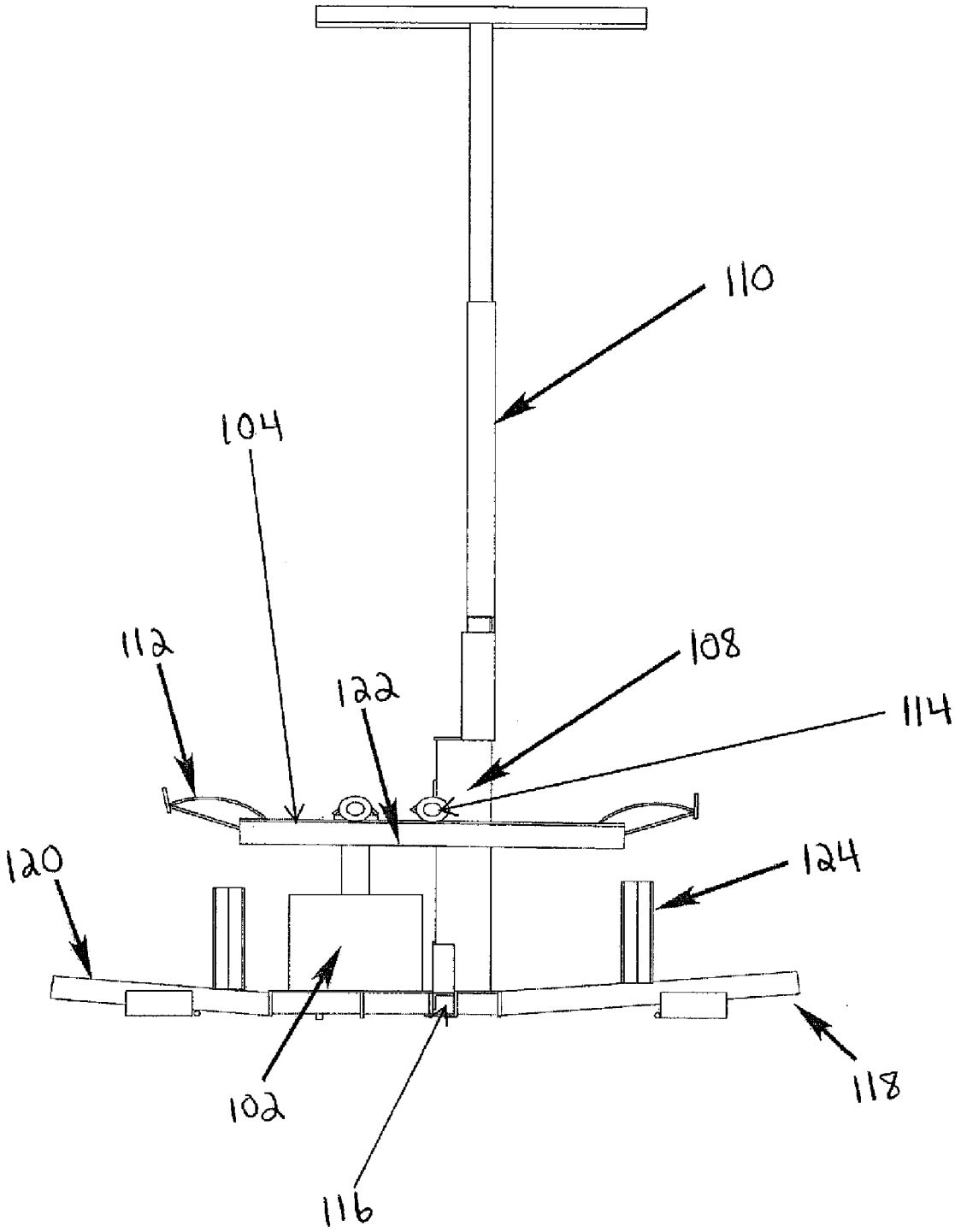
FIG. 3 is a front view of the present invention.
Figure 4:
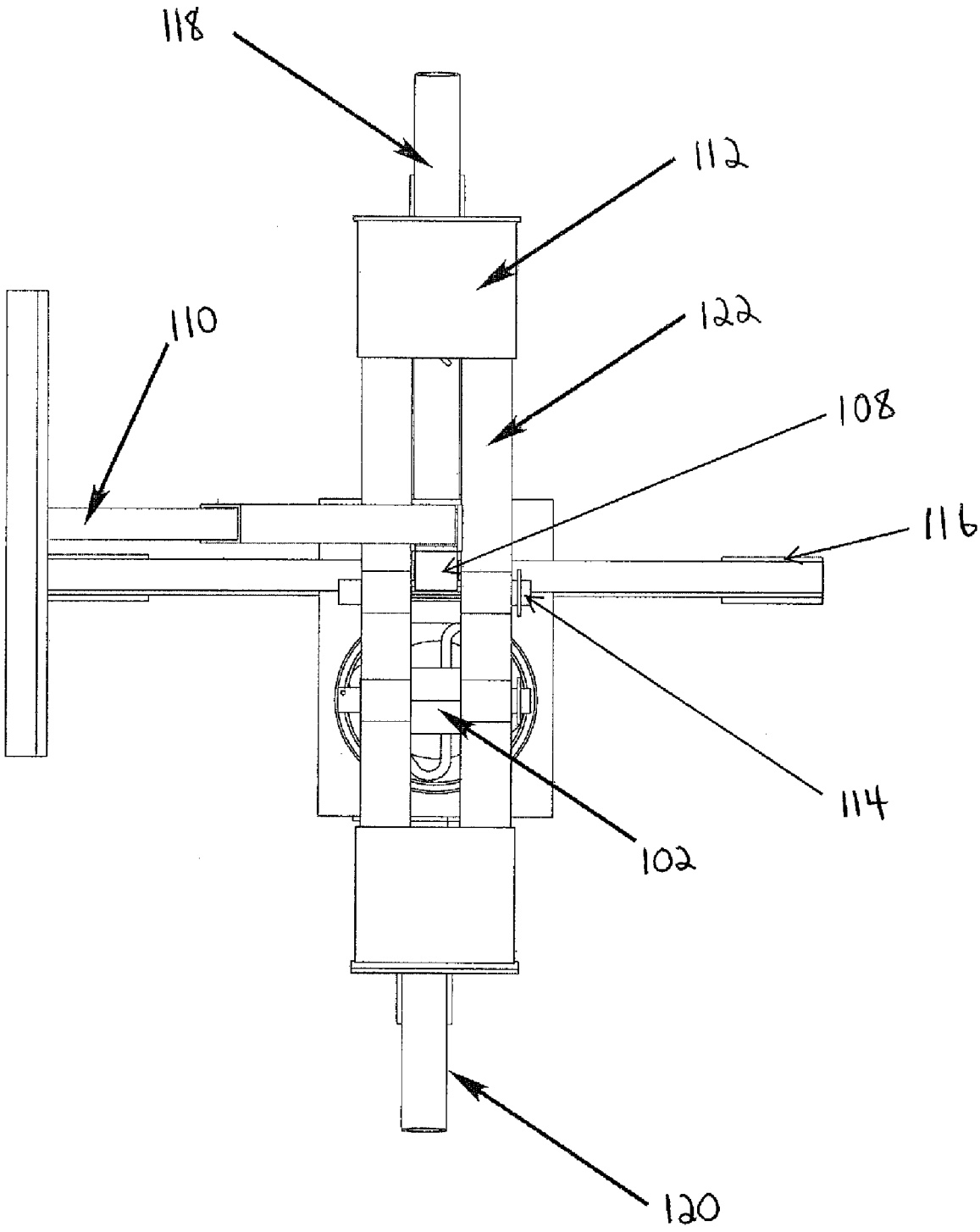
FIG. 4 is a top view of the present invention.
Figure 5A:
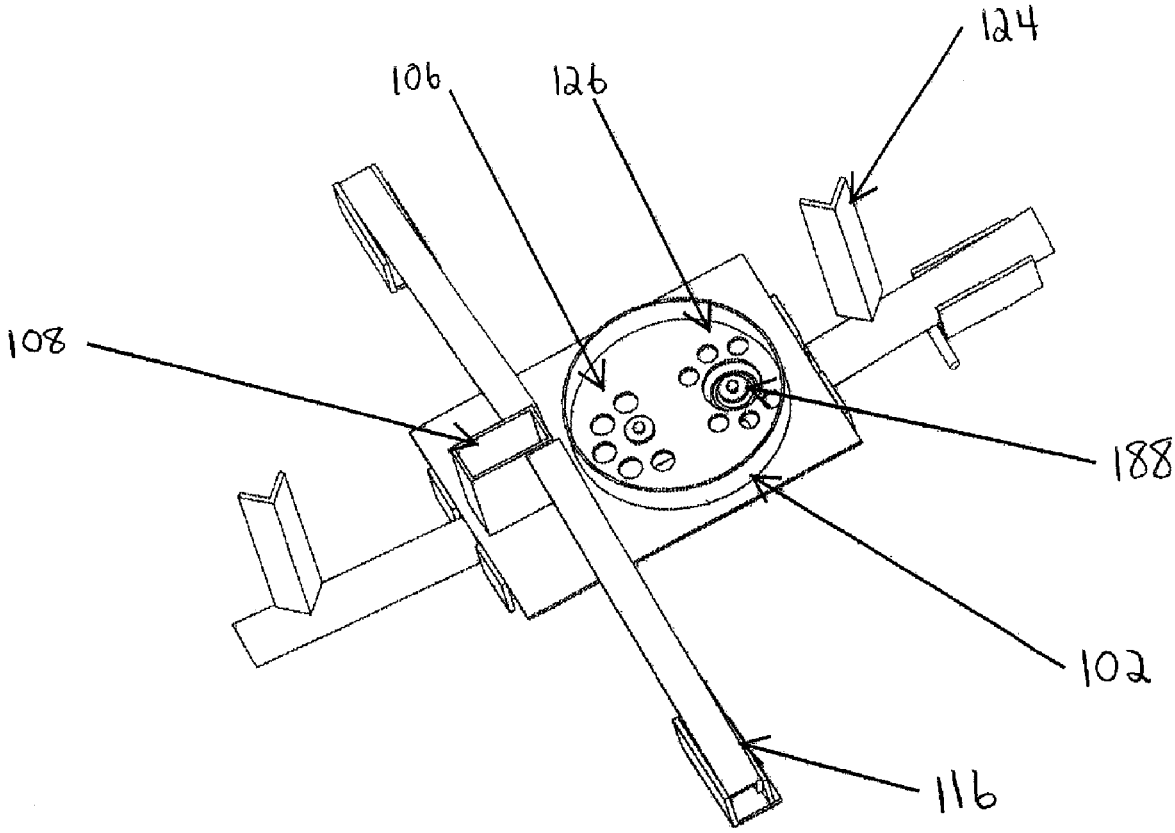
FIGS. 5*a, b, c* depict schematic cut-away perspective and cross-sectional views of various components of the present invention.
Figure 5B:
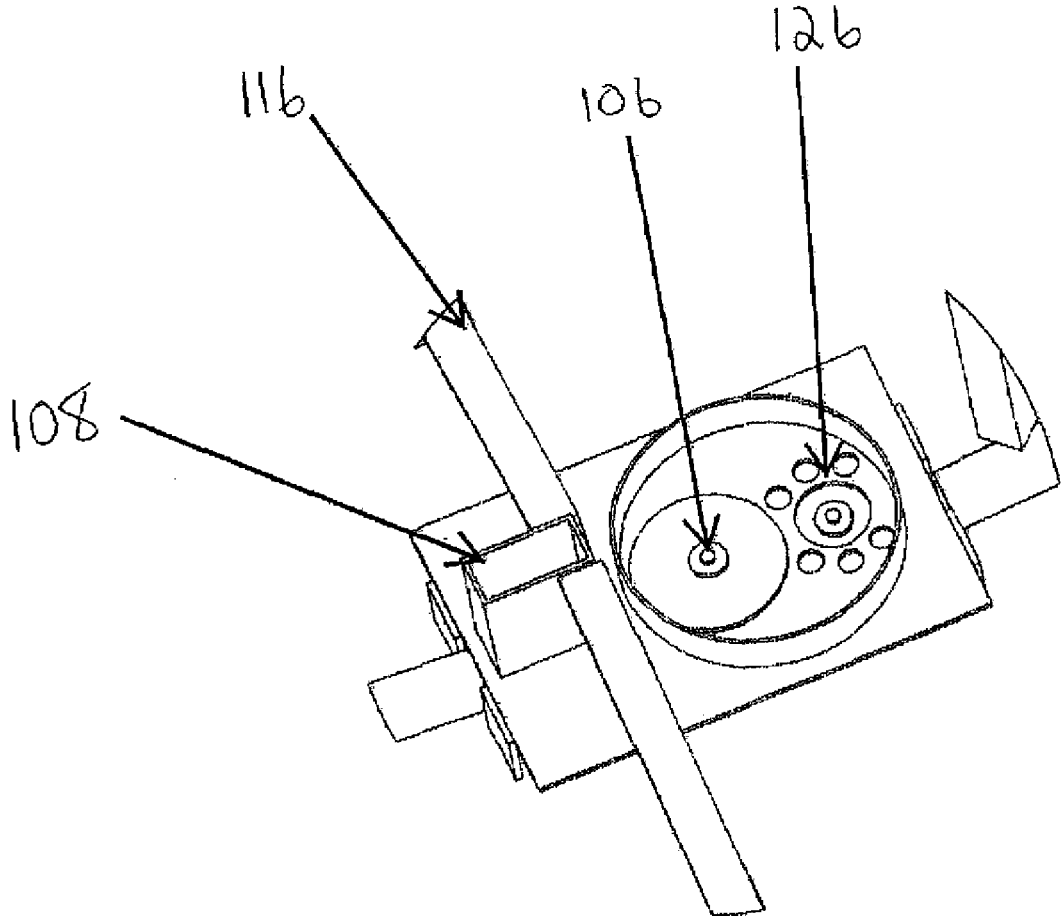
Figure 5C:
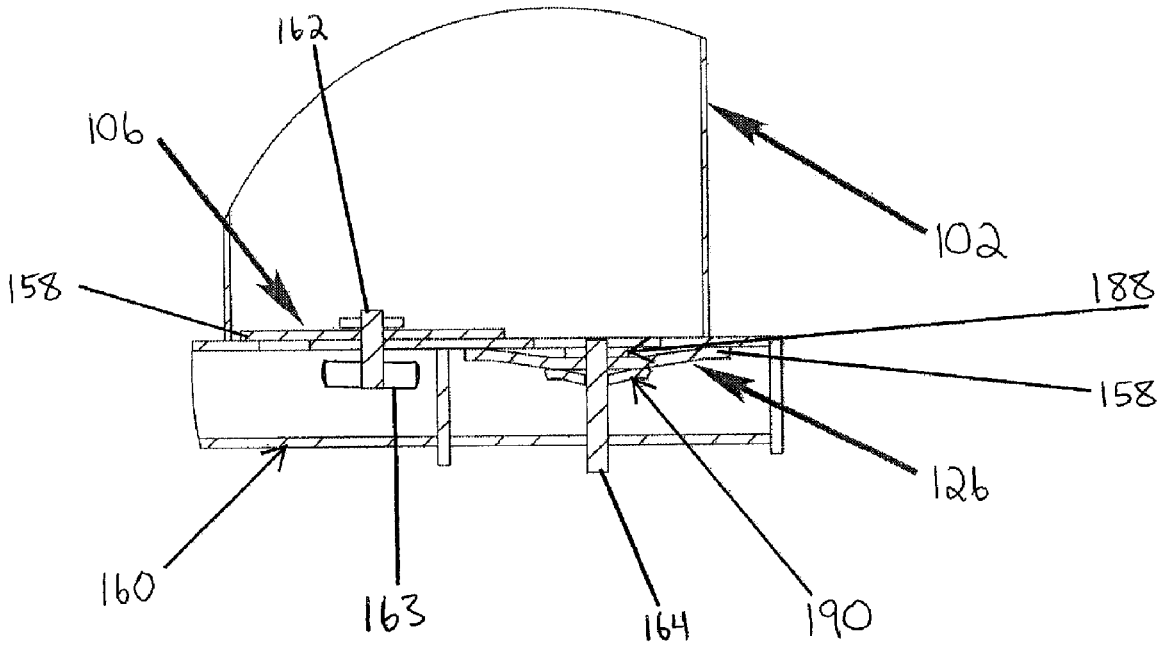
Figure 6:
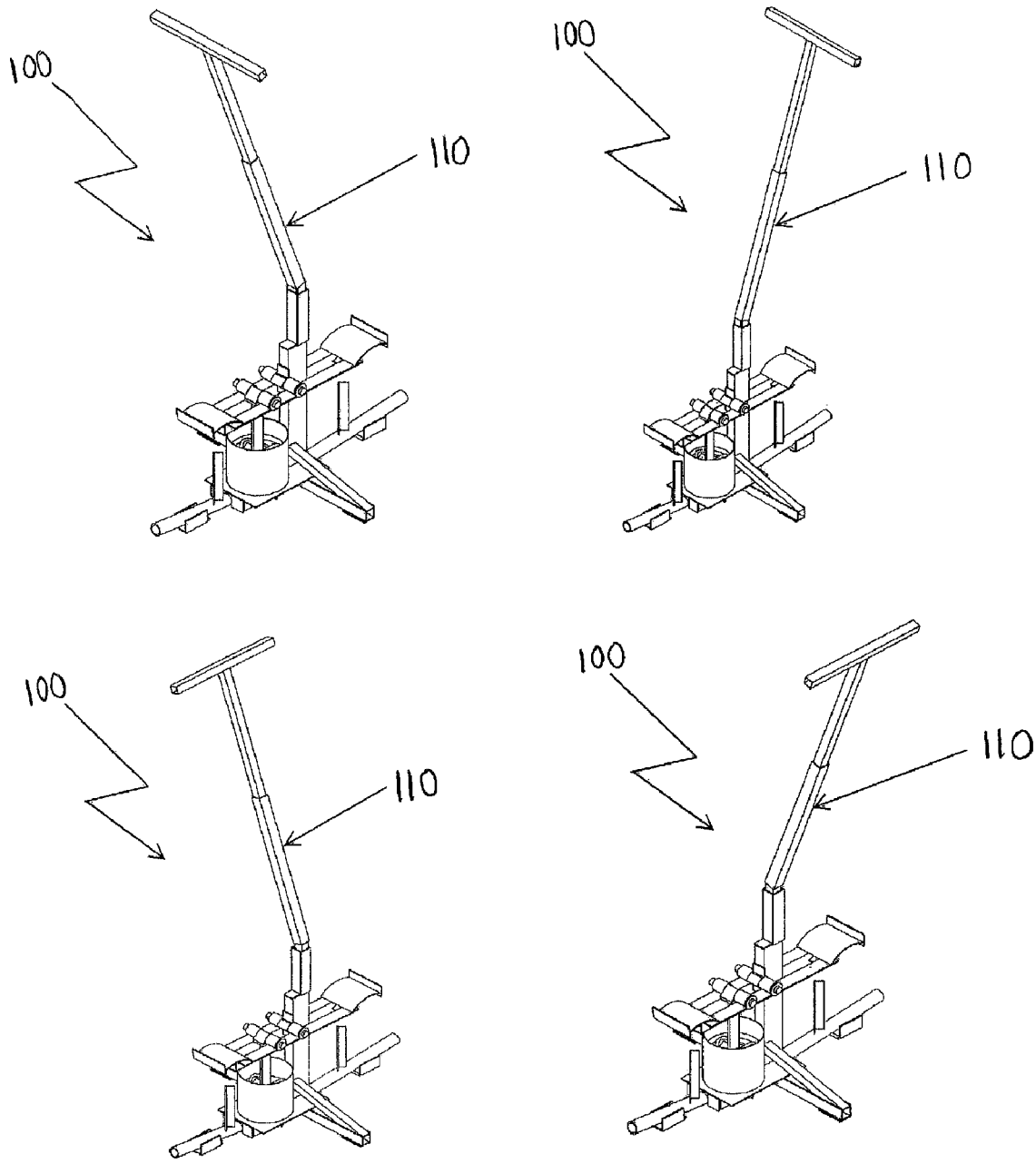
FIG. 6 depicts the various positions of the multi-position handle component of the present invention.
Figure 7:
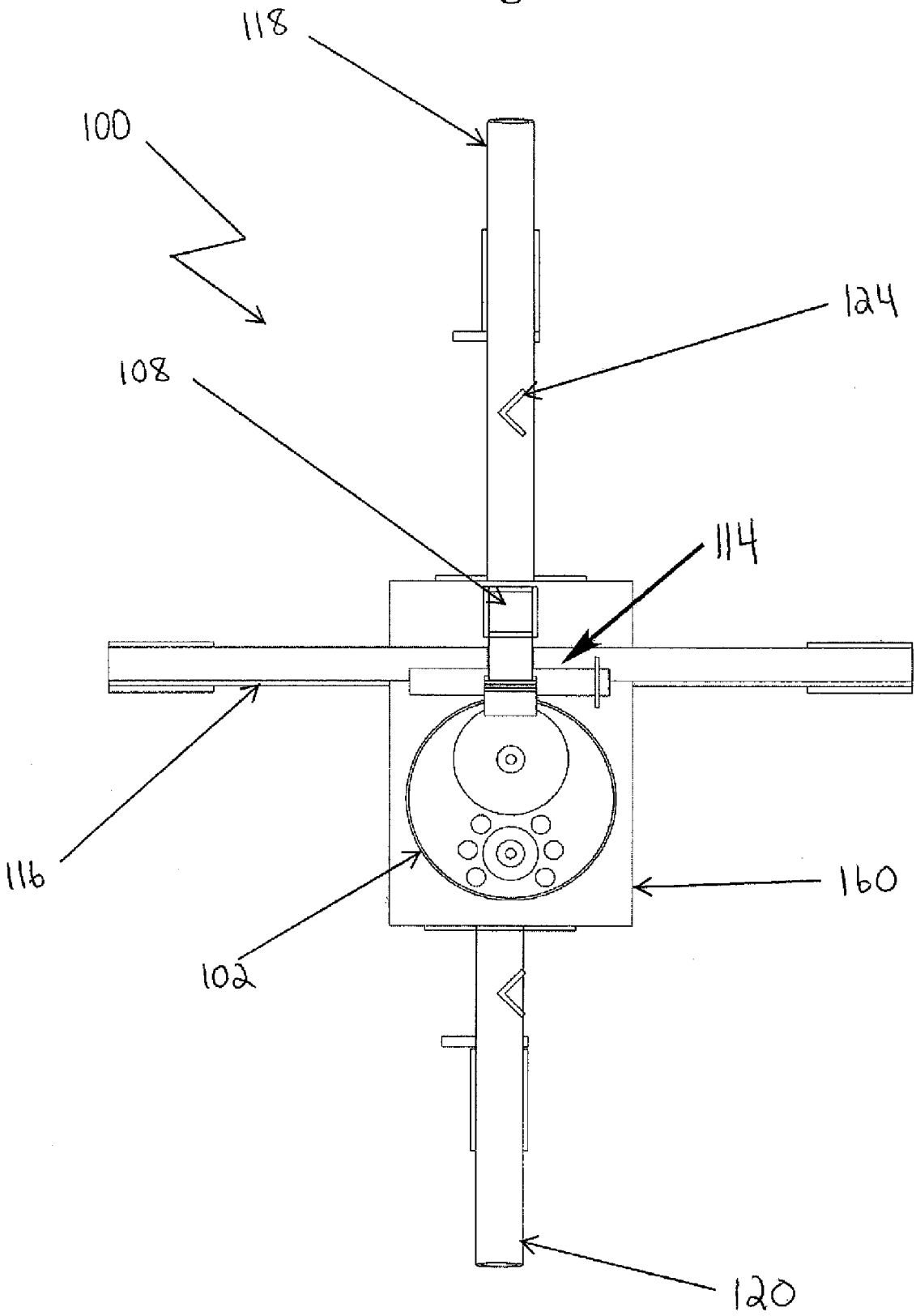
FIG. 7 depicts a cut-away top view of the present invention.
Figure 8:
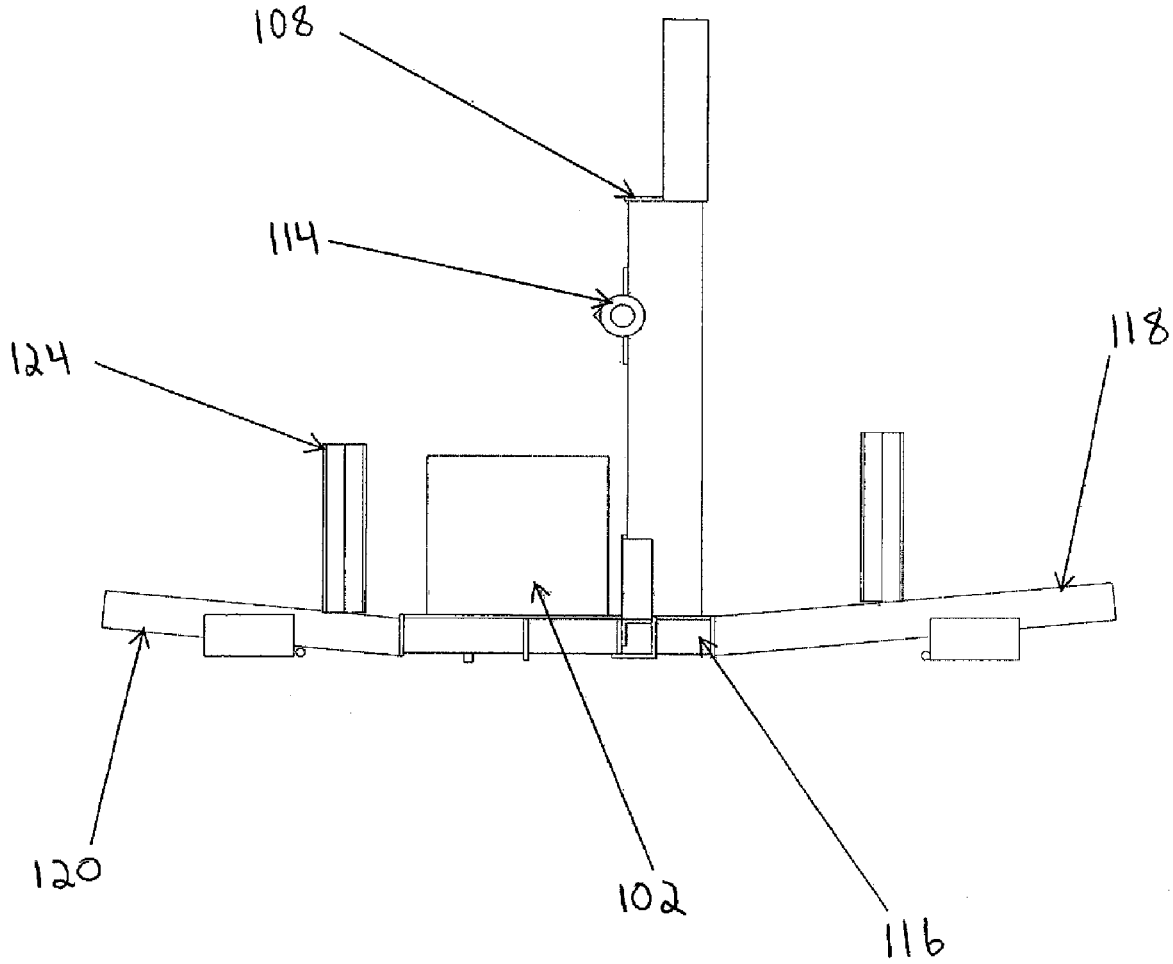
FIG. 8 is a front view of the frame component of the present invention.
Figure 9:
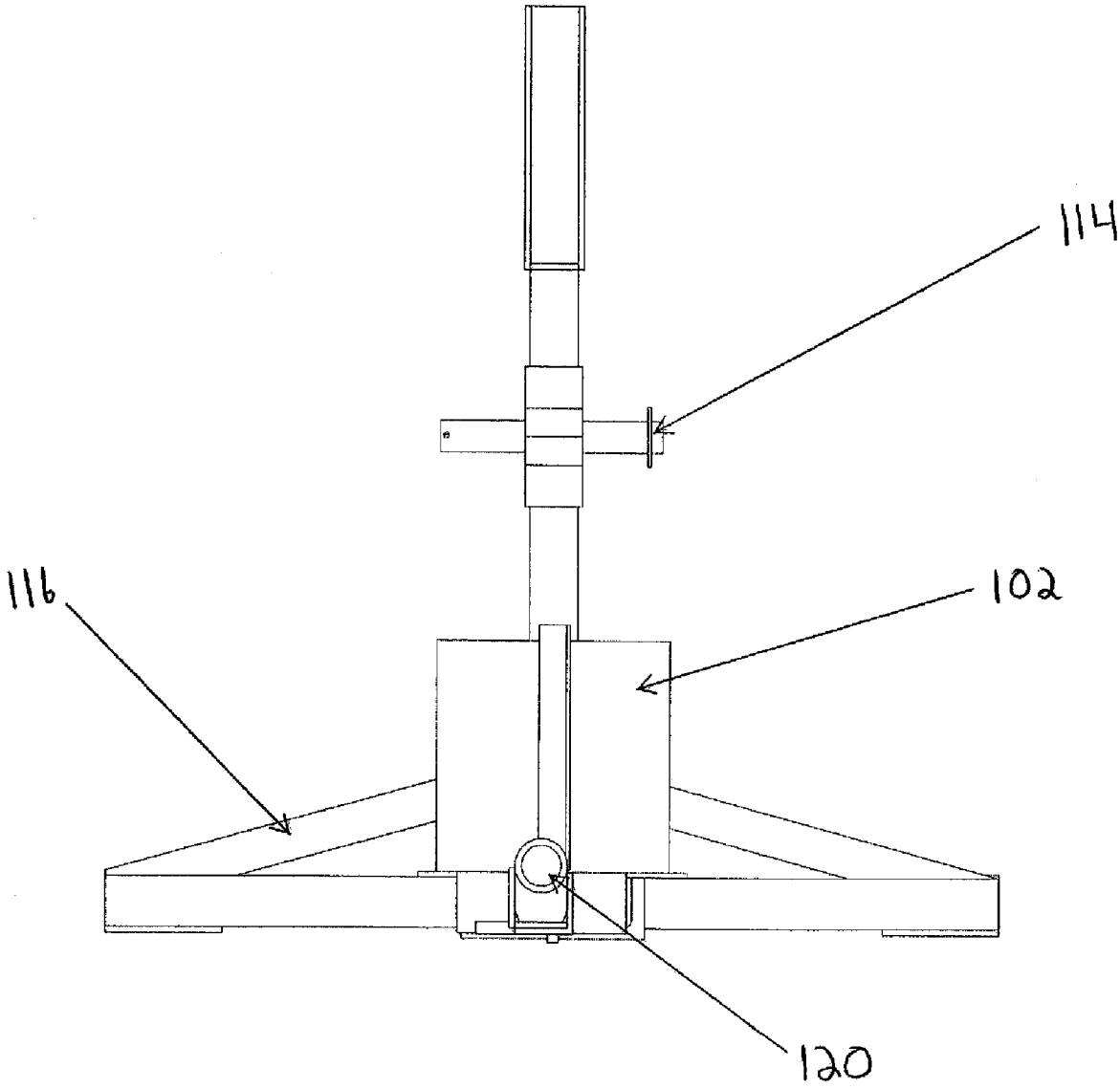
FIG. 9 is a side view of the frame component of the present invention.
Figure 10A:
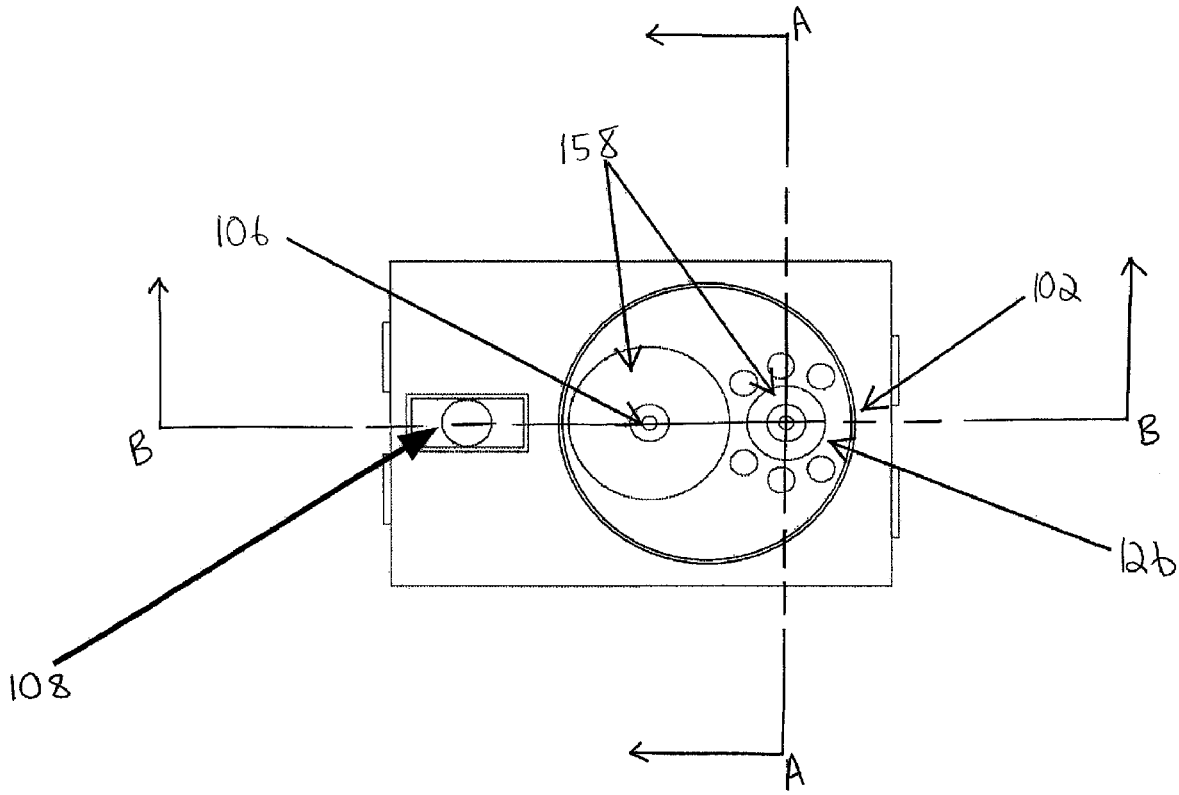
FIGS. 10*a, b*, and *c* are cut-away top and cross-sectional views of the surge chamber and cylinder of the present invention.
Figure 10B:
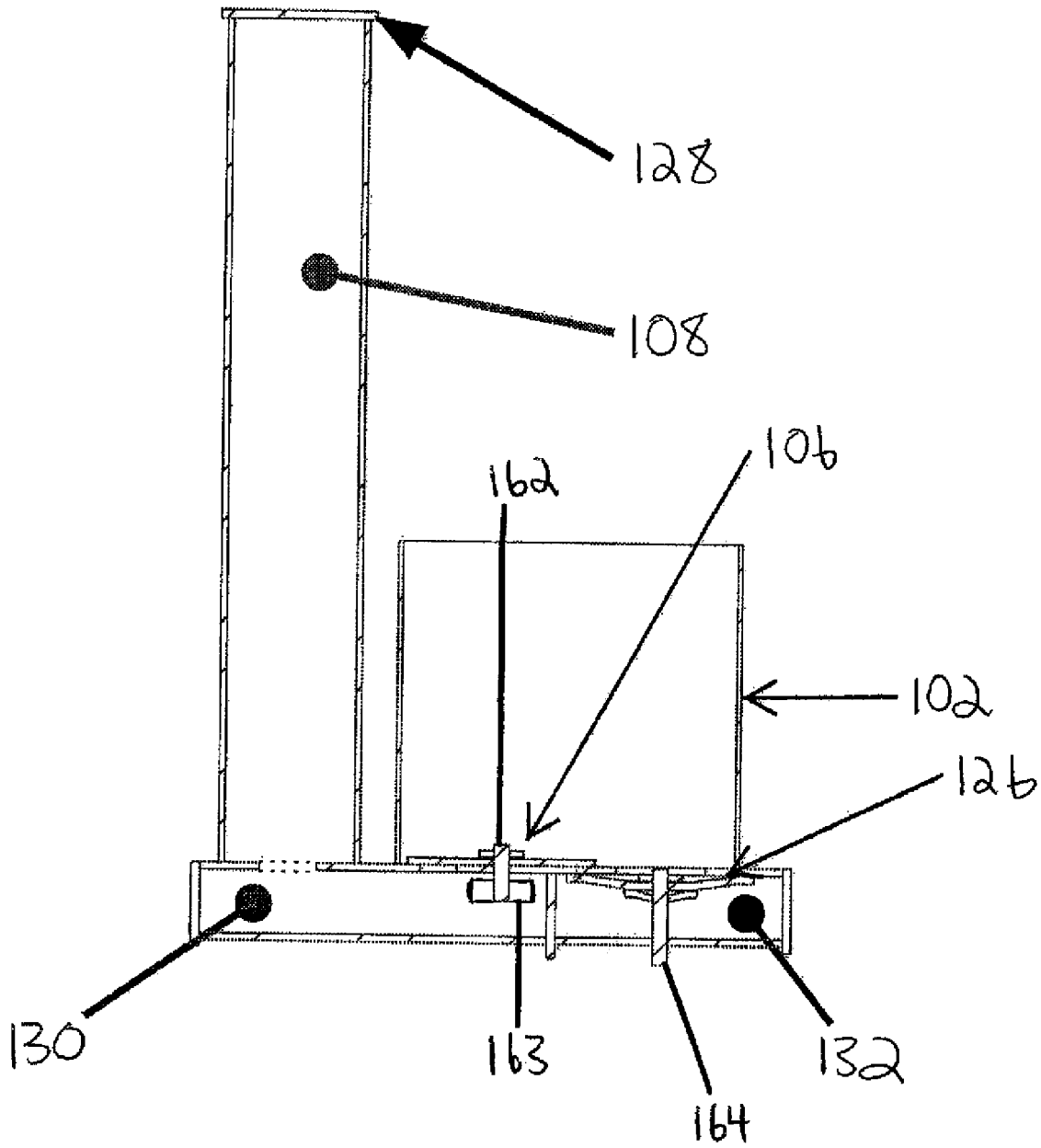
Figure 10C:
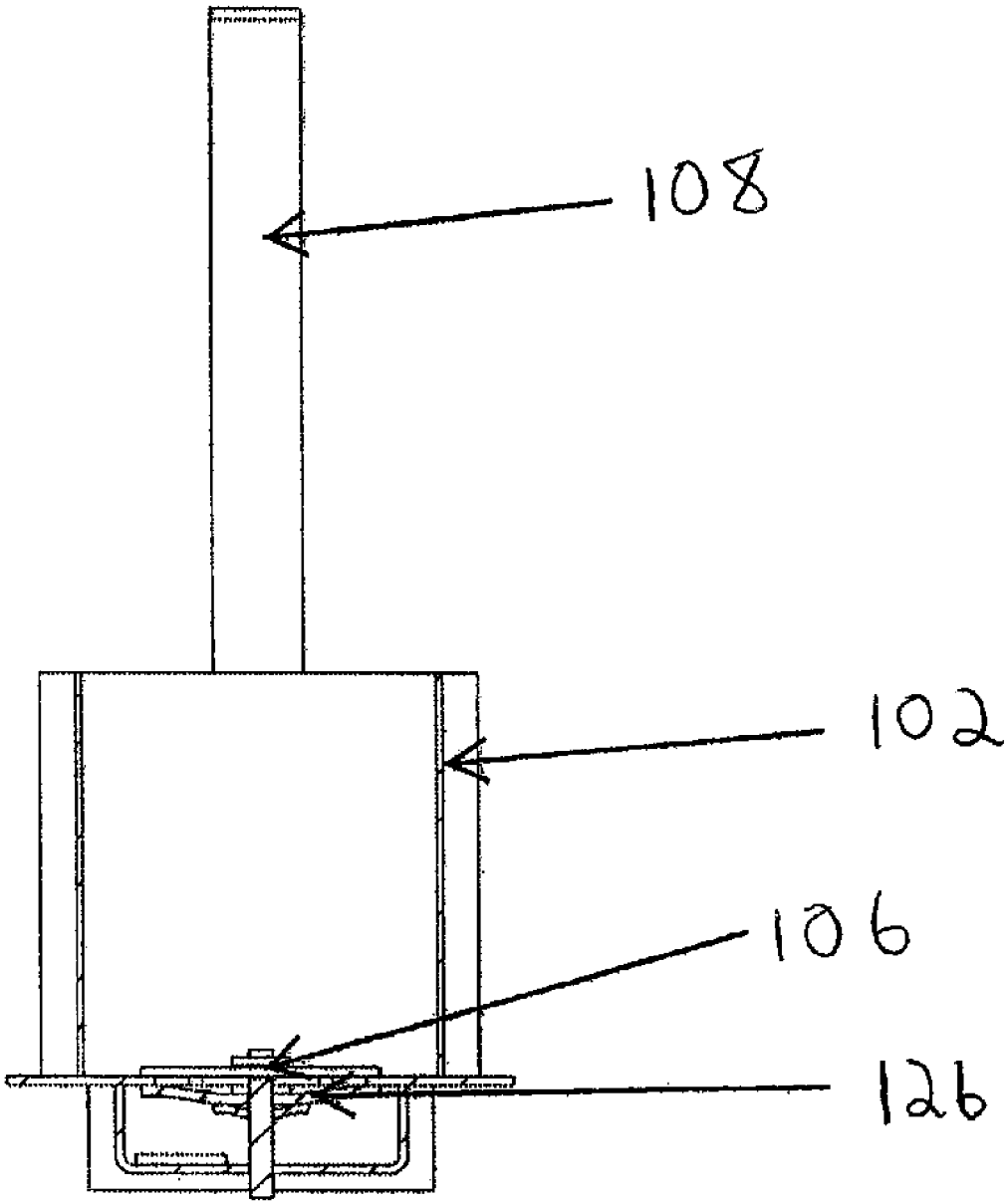
Figure 11A:
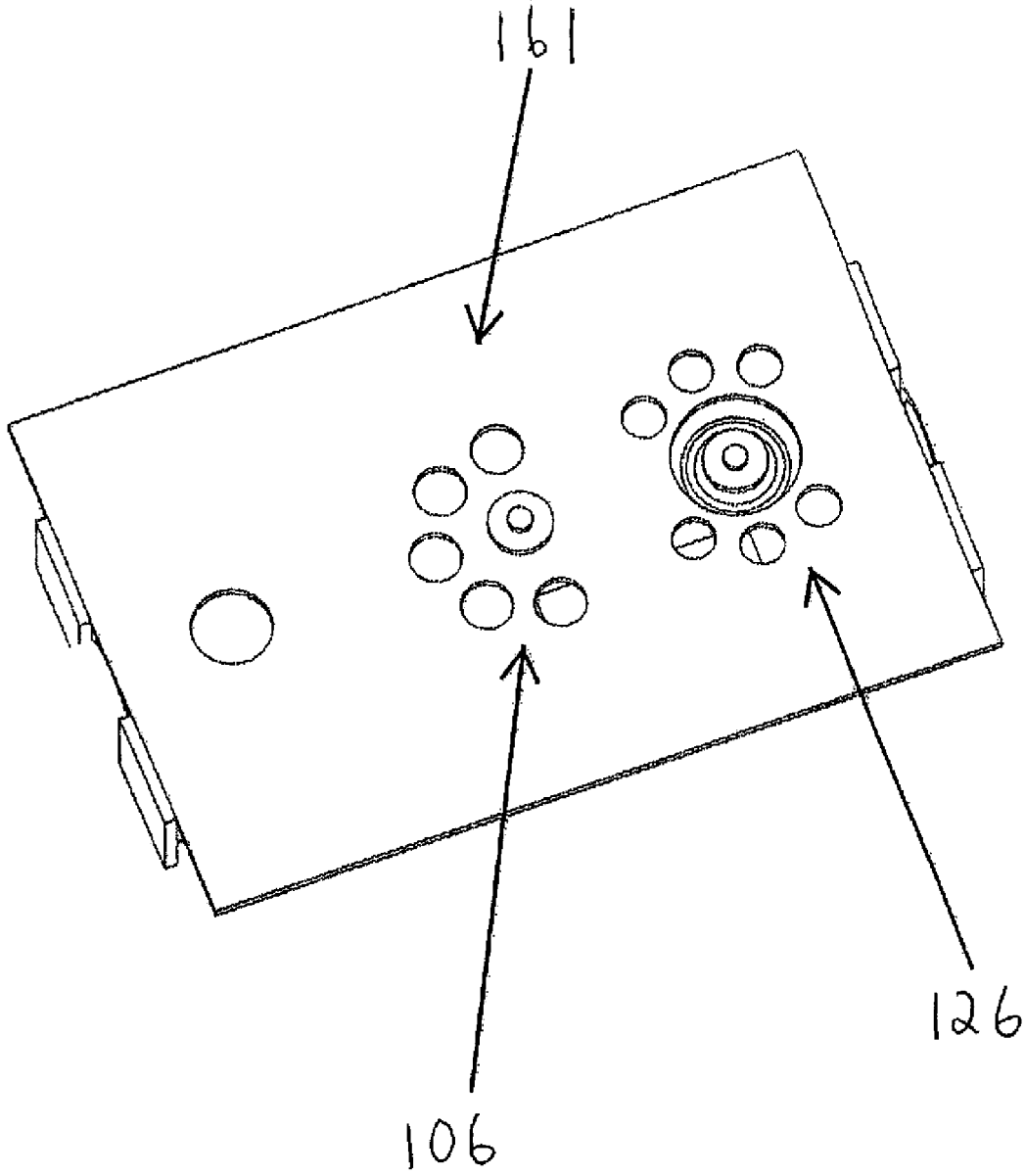
FIGS. 11*a, b, c*, and *d* are perspective and cross-sectional views of the components of the pumping system of the present invention.
Figure 11B:
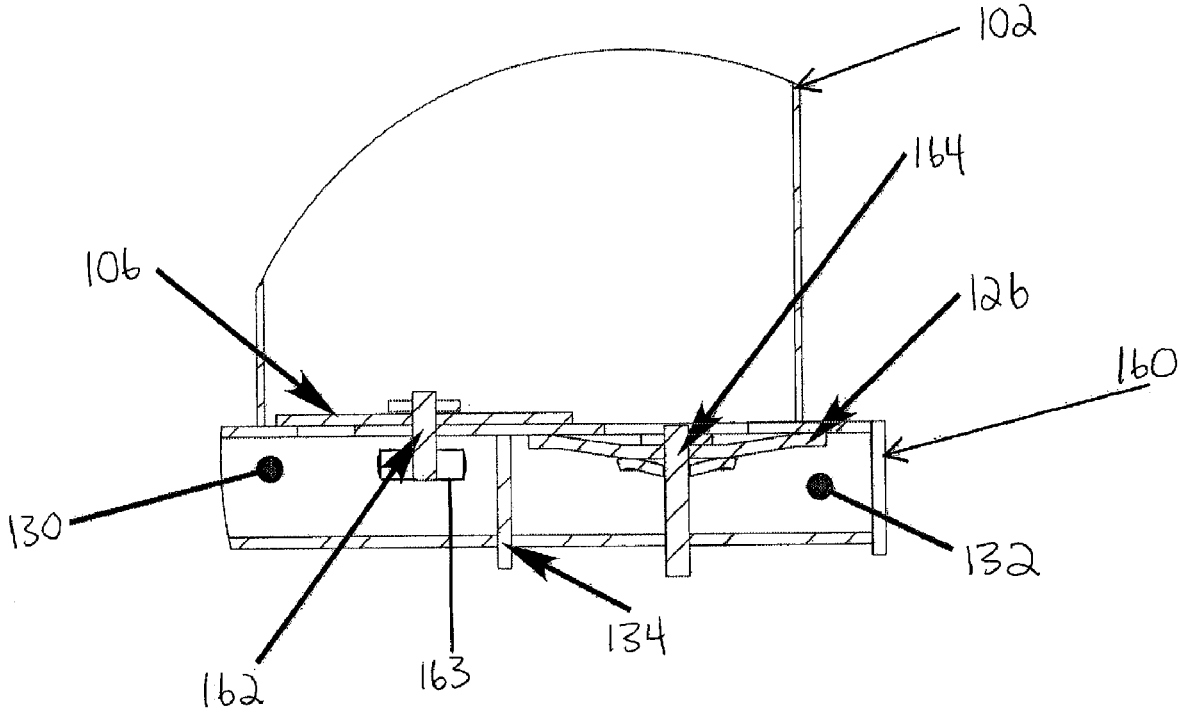
Figure 11C:
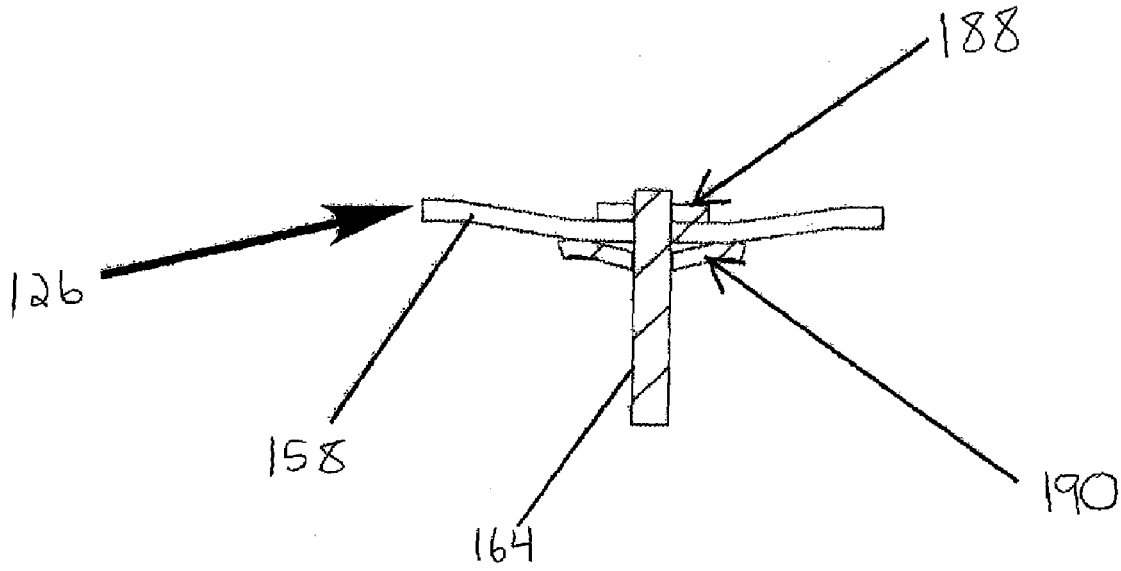
Figure 11D:
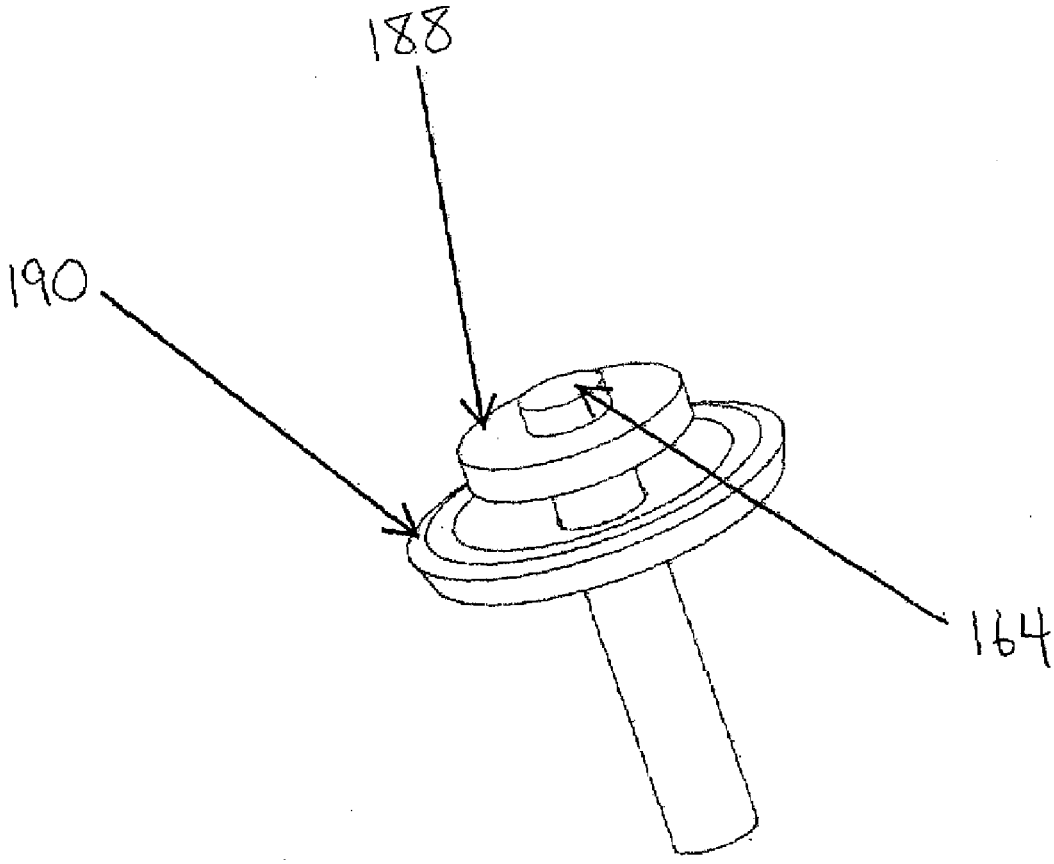
Figure 12:
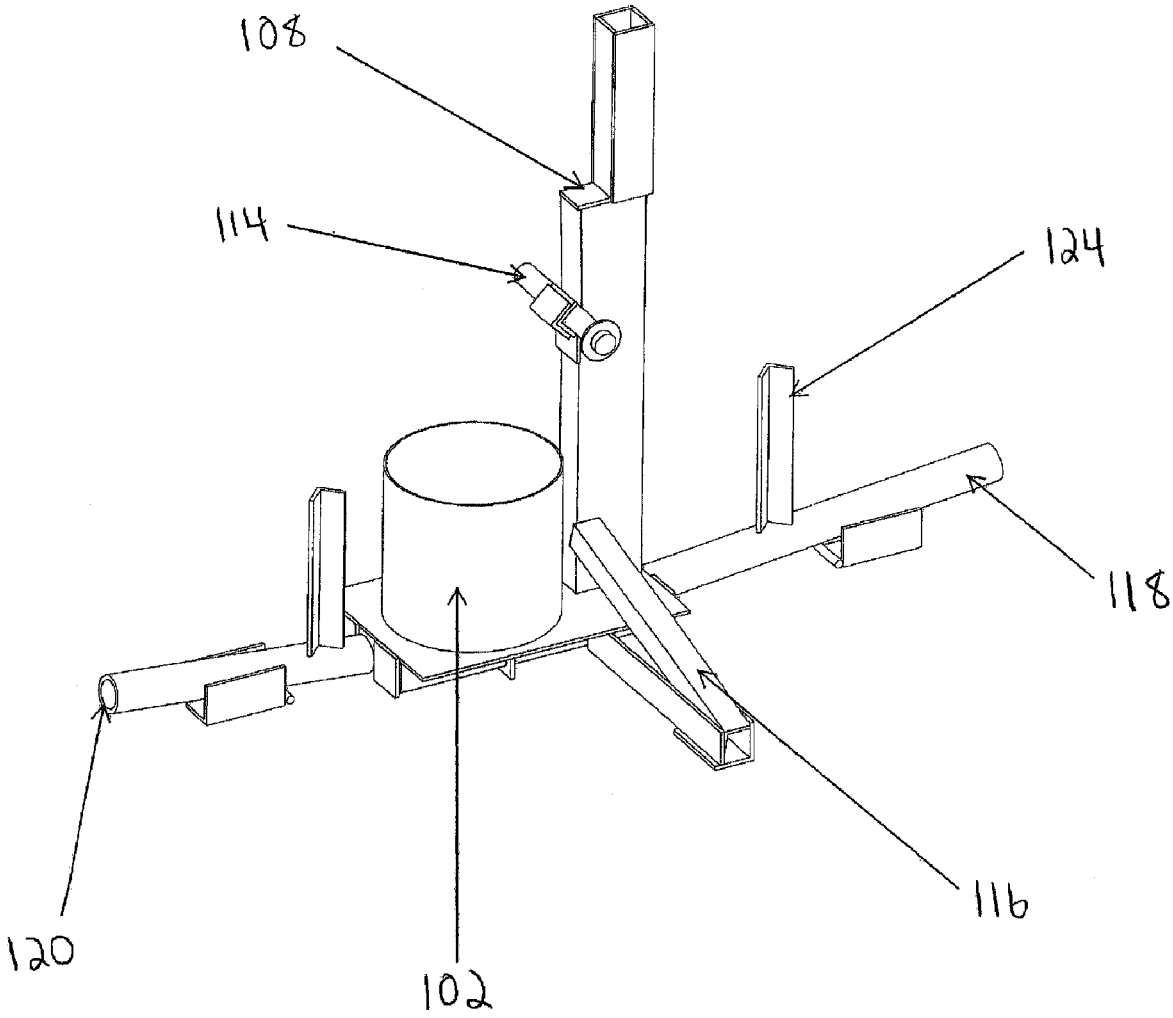
FIG. 12 is an isometric view of the lower frame and surge cylinder of the present invention.
Figure 13:
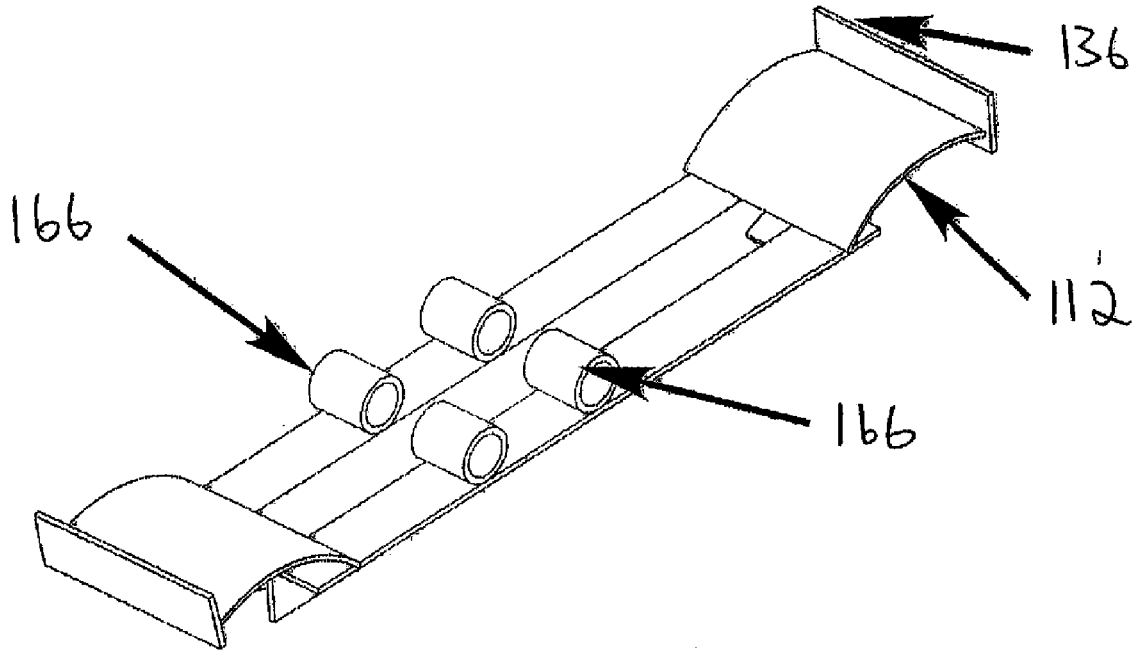
FIG. 13 is a perspective view of the treadle of the present invention.
Figure 14A:
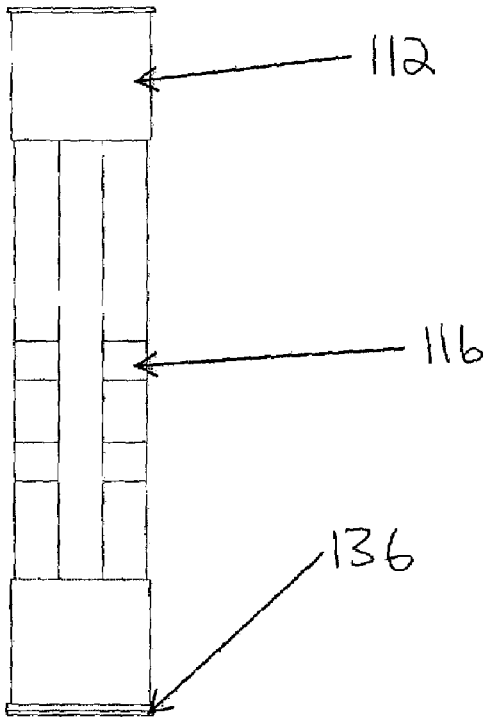
FIGS. 14*a*, *b*, and *c* are a top view, side view, and front view respectively of the treadle of the present invention.
Figure 14B:
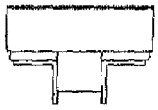
Figure 14C:
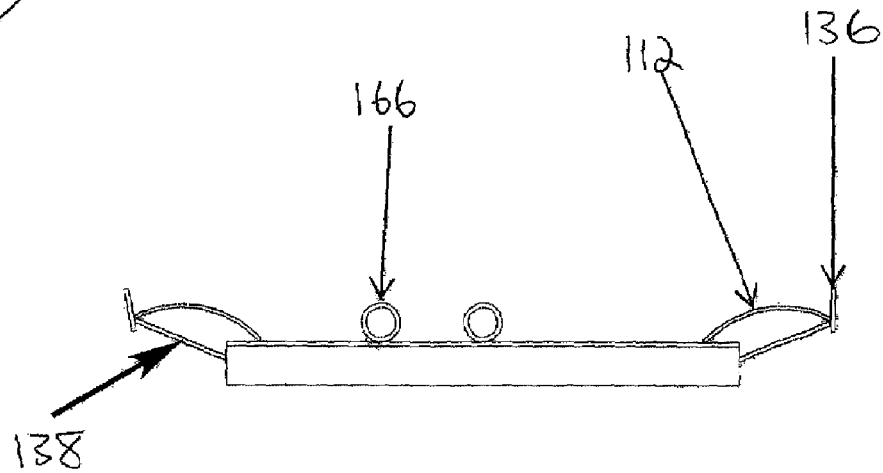
Figure 15A:
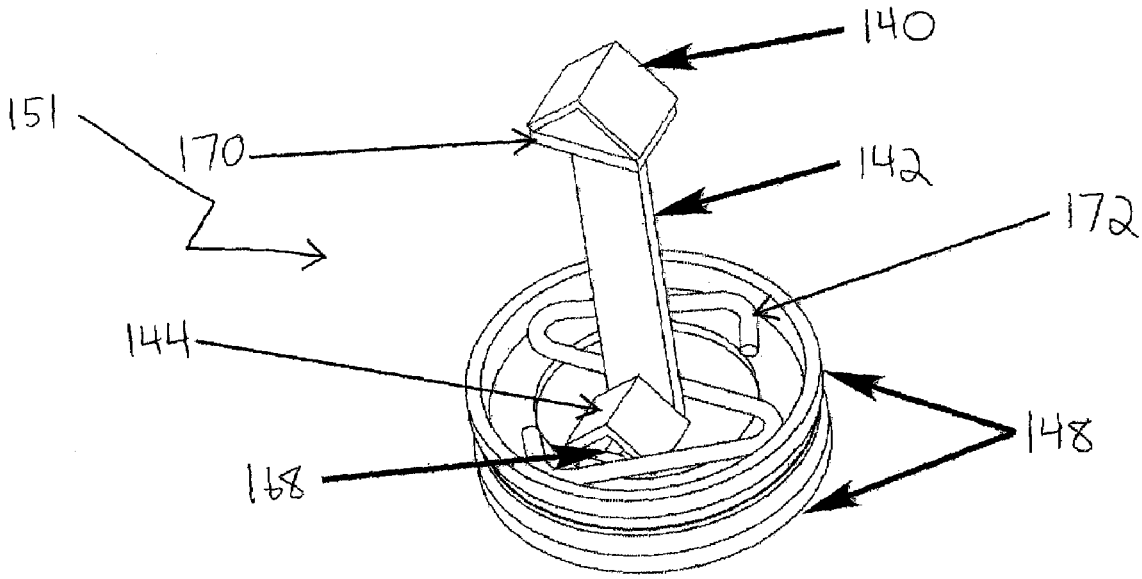
FIGS. 15*a* and *b* are perspective views of the piston of the present invention.
Figure 15B:
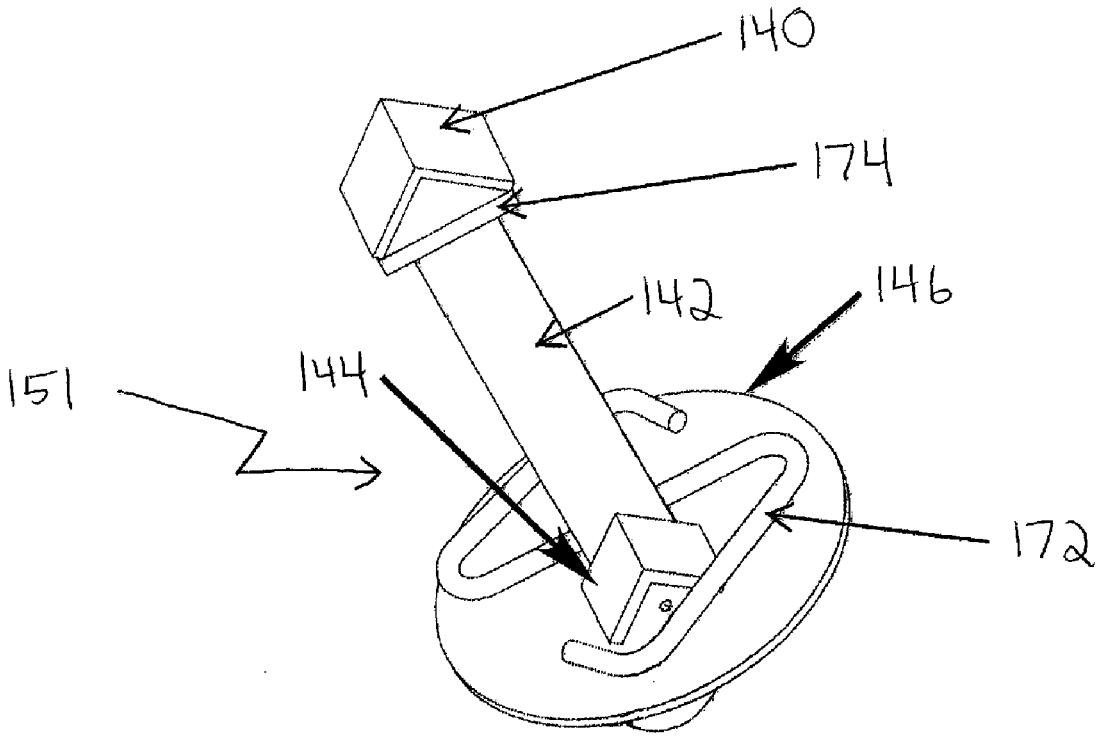
Figure 16A:
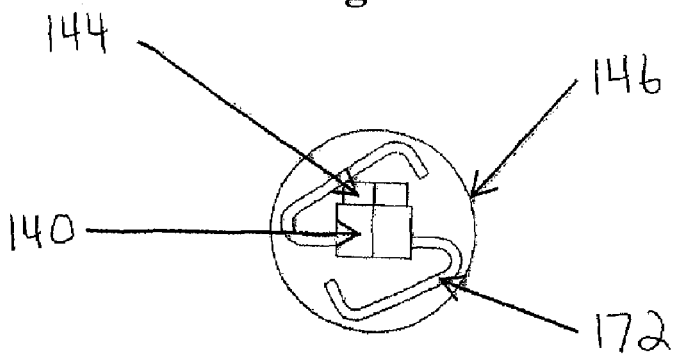
FIGS. 16*a, b*, and *c* are a top view and side views of various components of the piston of the present invention.
Figure 16B:
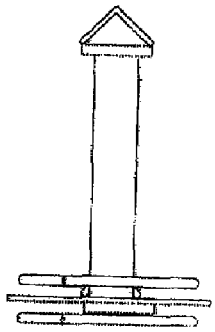
Figure 16C:
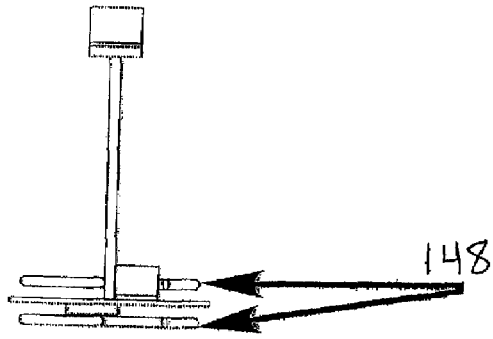
Figure 17A:
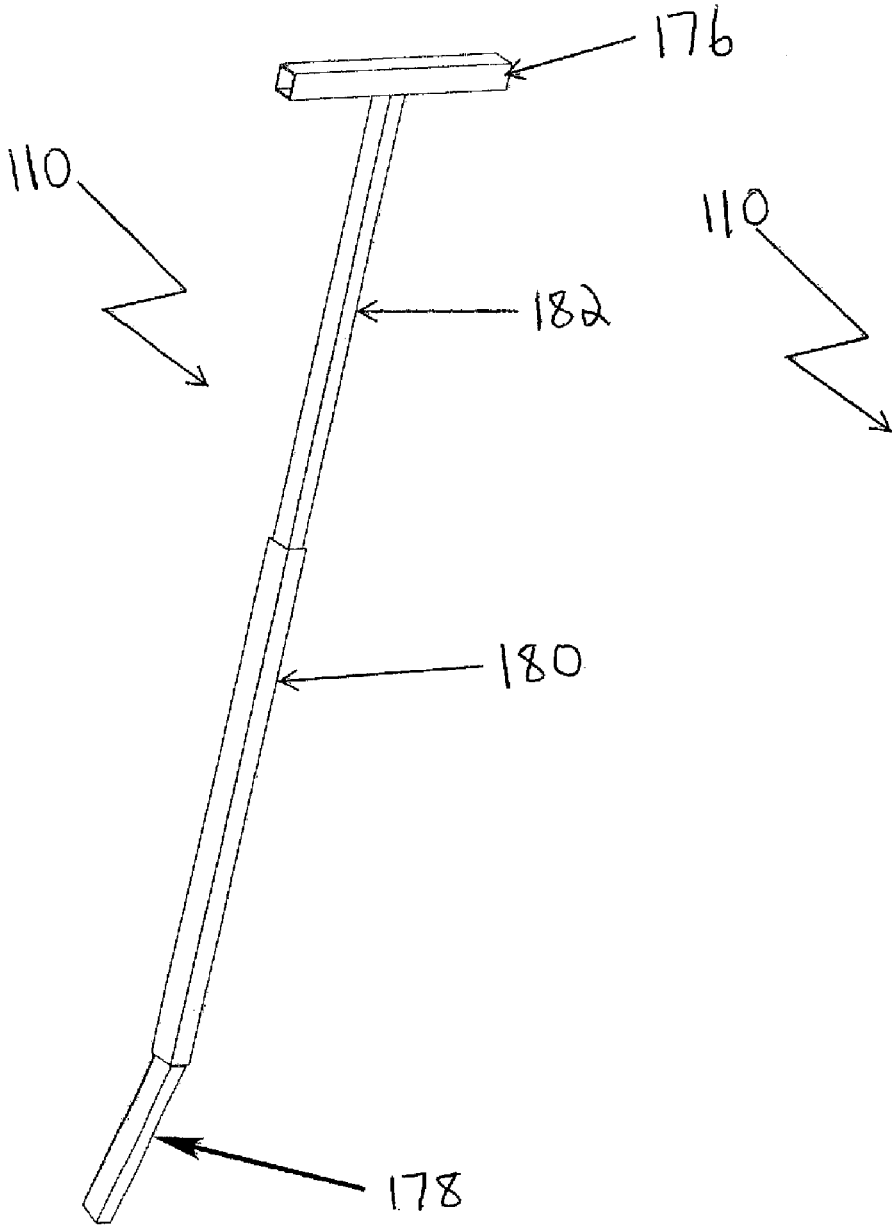
FIGS. 17*a* and *b* are a perspective view and a side view respectively of the handle of the present invention.
Figure 17B:
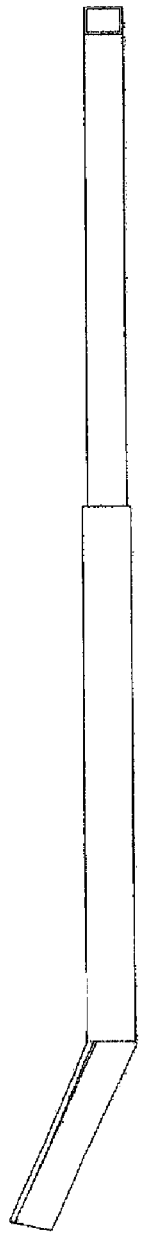
Figure 18A:
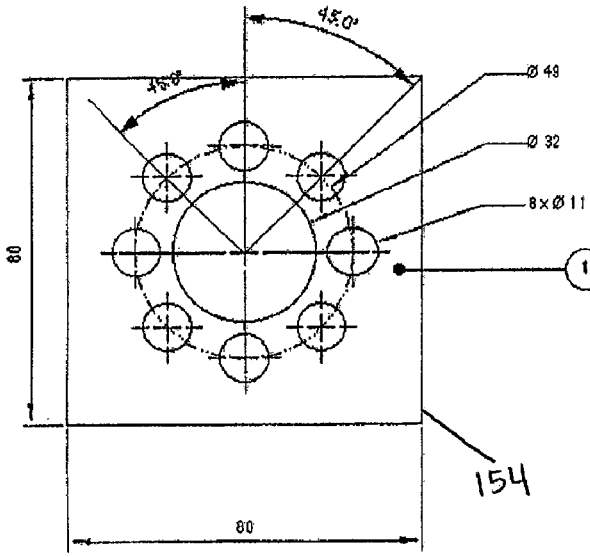
FIGS. 18*a* and *b* are top views of components of the foot valve of the present invention.
Figure 18B:
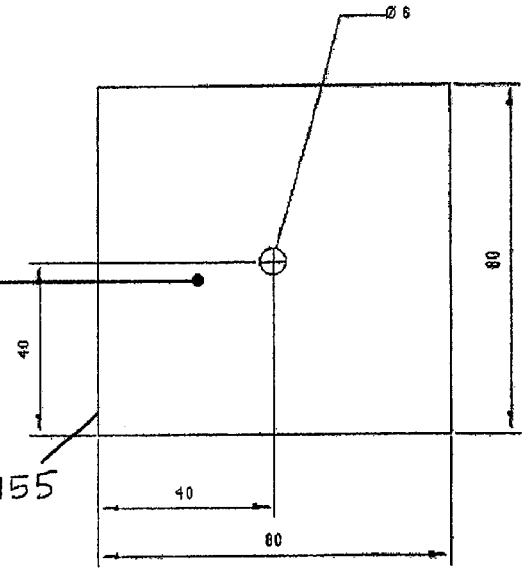
Figure 19:
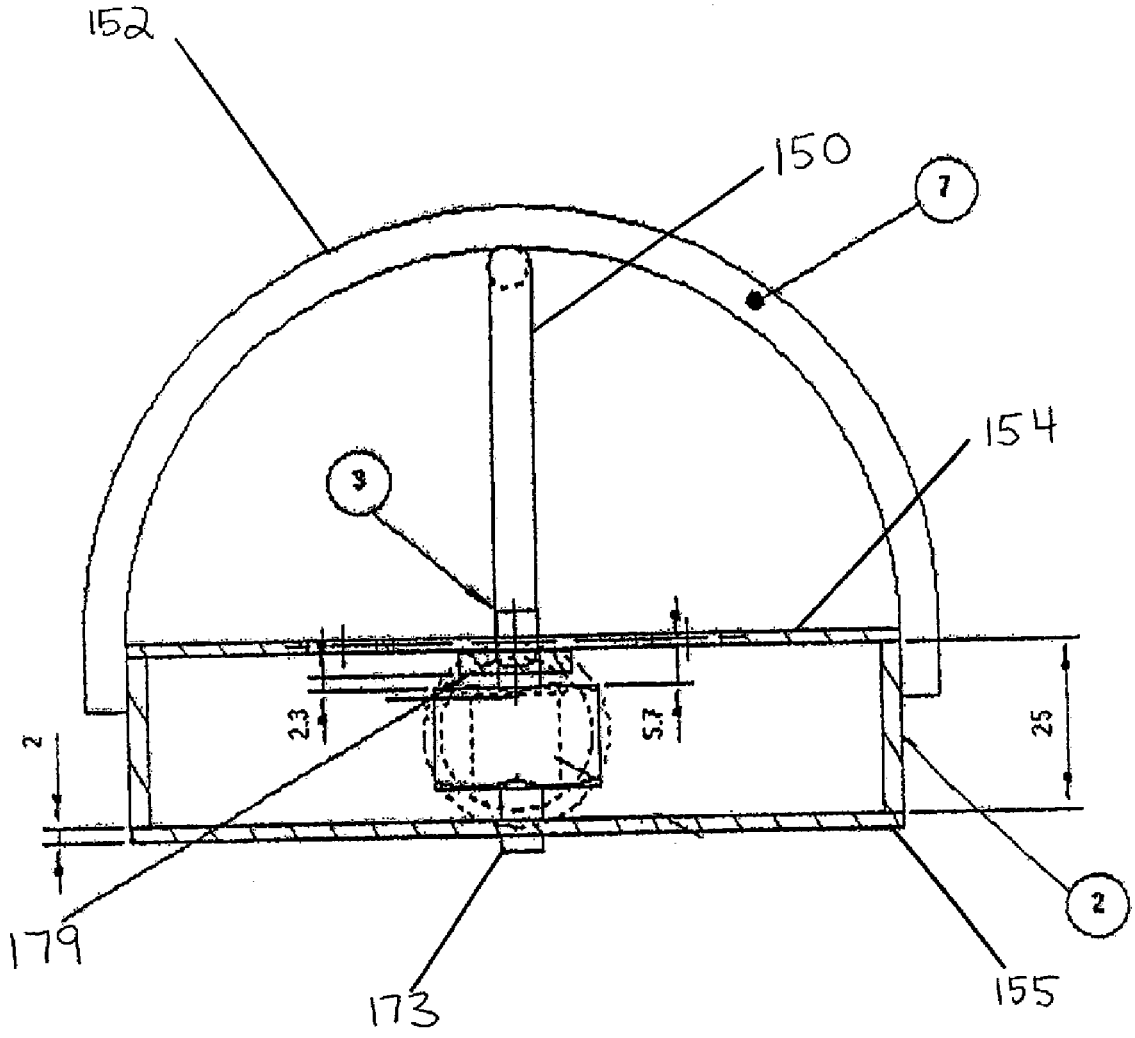
FIG. 19 is a cross section view of the foot valve of the present invention.
Figure 20:
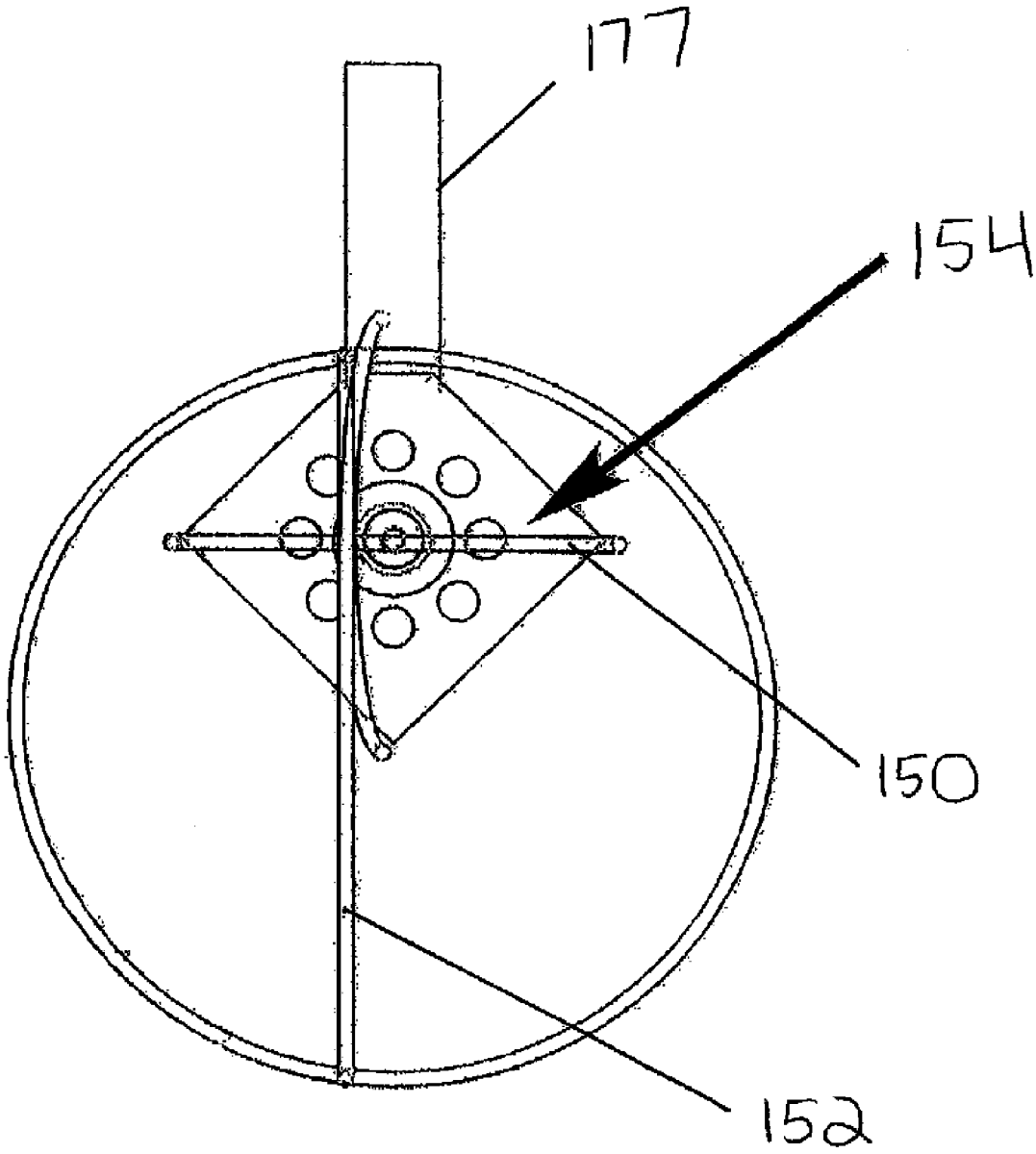
FIG. 20 is a top cut away view of the foot valve of the present invention.
Figure 21:
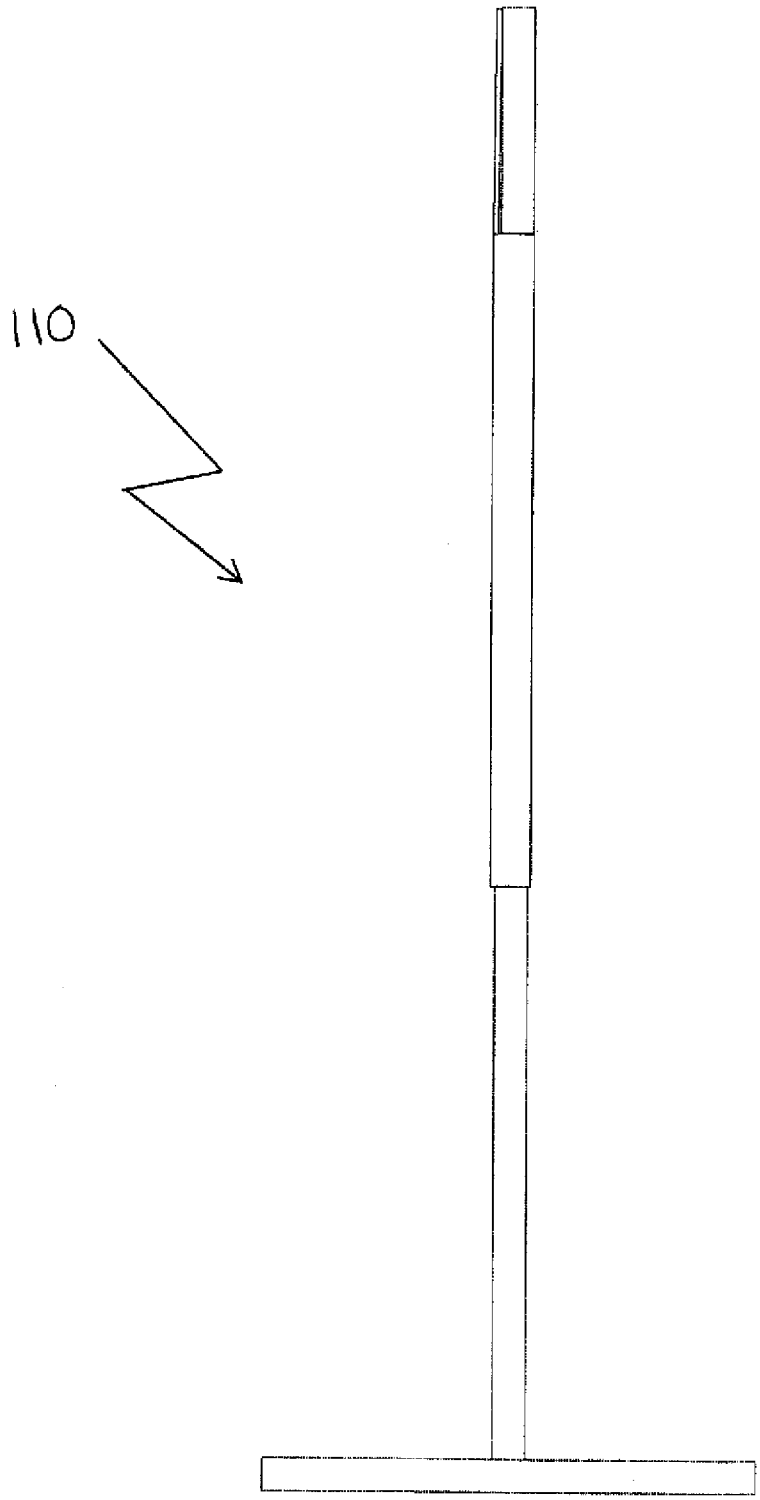
FIG. 21 is a side view of the handle of the present invention.

Turning now to FIG. 1, there is shown perspective view of the present invention and its various components. There is shown a frame 116 having a pivotally mounted rocker 104 for mounting contoured footpads 112, a treadle 122, and treadle stoppers 124, a surge chamber 108, a dual action piston and cylinder 102 with an outlet valve and a multi position handle 110. Pivots 114 (shown as a treadle pivot and a piston pivot) connect to the treadle 122. Inlet pipe 118 and outlet pipe 120 are shown to indicate the flow of liquid, particularly water, through the micro irrigation pump. Turning now to FIG. 2, the side view of the present invention is shown. There is shown a frame 116 for mounting contoured footpads 112 and a rocker 104, a dual action piston and cylinder 102, a multi position handle 110, and an inlet pipe 118. Turning now to FIG. 3, the front view of the pump 100 of the present invention is shown. There is also shown a frame 116 having treadle stoppers 124 and a rocker 104 with a treadle 122, contoured footpads 112, and pivots 114. Also shown are the surge chamber 108, the dual piston and cylinder 102, the multi position handle 110, the inlet pipe 118, and the outlet pipe 120. FIG. 4 depicts a top view of the pump 100 of the present invention showing a frame 116 having a treadle 122, pivots 114, and a contoured footpad 112, a dual action piston and cylinder 102, a surge chamber 108, and a multi position handle 110. Also shown are the inlet pipe 118 and outlet pipe 120. Turning to FIG. 5*a*, there is shown a perspective cut away view of the valve box of the present invention. FIG. 5*a* depicts the cut away cylinder 102 and surge chamber 108 showing the multiple apertures and a contoured upper valve support surface 188. Also shown are the frame 116 and treadle stoppers 124. FIG. 5*b* depicts the perspective view of the outlet valve 126, showing the valve seal 158, which is inserted through the larger hole shown and stretched over the upper support surface 188 and tensioned by the concavity of the lower support surface 190 (FIG. 5C). A detailed section view of the outlet valve 126 is shown in FIG. 5*c*, which depicts the valve box 160, including the inlet valve 106, the outlet valve 126, and the cylinder 102. Turning now to FIG. 6, there is shown four perspective views of the pump 100 of the present invention wherein the pump handle 110 is depicted in each of four different positions possible for operation of the pump 100. Turning now to FIG. 7, there is shown a top cut-away view of the pump of the present invention. There is shown an inlet pipe 118 and an outlet pipe 120 of the pump 100, along with the surge chamber 108, the valve box 160, the frame 116, the cylinder 102, the treadle stopper 124, and the pivot 114. Turning now to FIG. 8, there is shown a front view of frame 116 of the frame component of the present invention with the footpads 112 and the treadle 122 removed. There is shown the surge chamber 108, the pivot 114, the cylinder 102, the treadle stopper 124, the inlet pipe 118, and the outlet pipe 120. Turning now to FIG. 9, there is shown a side view of the frame 116 of the frame component of the present invention with the footpads 112 and treadle 122 removed. Shown are the pivot 114, the cylinder 102, and the outlet pipe 120. Turning now to FIG. 10*a*, there is shown a top cut away view of the various components of the valve assembly (showing the outlet valve 126, the inlet valve 106, and the valve seals 158) of the present invention, including the surge chamber 108 and the cylinder 102. Turning now to FIG. 10*b*, there is shown a front section view of the cylinder 102, taken at line B-B of FIG. 5*a*, depicting the inlet valve 106, the outlet valve 126, and the surge chamber 108 with a surge chamber cover 128. The surge chamber 108 is connected to a suction channel 130. Also shown is a pressure channel 132. FIG. l0*c* depicts a section view of the cylinder 102, taken at line C-C of FIG. 5*a*, which depicts the surge chamber 108, the cylinder 102, and the outlet valve 126. Turning now to FIG. 11*a*, there is shown a perspective view of a valve plate of the valve box 161. FIG. 11*b* depicts a section view through the valve box 160 and the cylinder 102 showing the outlet valve 126 and inlet valve 106 of the pump assembly of the present invention. The suction channel 130 is contained separately from the pressure channel 132 by a channel separator 134. The pressure channel 132 includes the outlet valve 126, which is secured via the outlet valve rod 164, and the suction channel 130 includes the inlet valve 106, which is secured via the inlet valve rod 162 and pressure washer 163. FIG. 11*c* depicts a side view of the outlet valve 126 in partial cross-section. FIG. 11*d* shows a perspective view of a portion of the outlet valve 126. Turning now to FIG. 12, there is shown perspective view of the pump frame 116 and surge cylinder mount of the present invention with the treadle 122 removed. Also shown are the cylinder 102, the surge chamber 108, the pivot 114, the treadle stopper 124, the inlet pipe 118, and the outlet pipe 120. Turning now to FIG. 13, there is shown a perspective view of the treadle 122 of the present invention having thereon a first and second foot support 136, a first and second foot rest 112, pivot connecting points 166, and a treadle connector. Turning now to FIG. 14*a*, there is shown a top view of the treadle of the present invention showing both the first and second foot supports 136, as well as the pivot connecting points 166 for pivotally mounting to the pump connecting rod, and the contoured foot pads 112. FIG. 14*b* depicts the side view of the treadle of the present invention. FIG. 14*c* shows the front view of the treadle of the present invention including the treadle connector 138, the pivot connecting points 166, the contoured footpads 112, and the treadle foot supports 136. Turning now to FIG. 15*a*, there is shown a perspective view of the piston 151 of the present invention showing a piston pivot 140, a piston pivot support 174, a piston rod 142, a leak valve 168, a leak valve holder 144, a reinforcement bar 172, and piston cups 148. FIG. 15*b* depicts a perspective view of the piston 151 of the invention with the leak valve 168 removed. Shown are a piston disk 146, the piston pivot 140, the piston pivot support 174, the piston rod 142, the leak valve holder 144, and the reinforcement bar 172. Turning now to FIG. 16*a*, there is shown a top view of the piston 151 of the present invention showing the piston pivot 140, the leak valve holder 144, the piston disk 146, and the reinforcement bar 172. FIG. 16*b* depicts a front view of the piston 151 of the present invention. FIG. 16*c* depicts a side view of the piston 151 of the present invention showing the piston cups 148. Turning now to FIG. 17*a*, there is shown a perspective view of the pump handle 110 of the present invention showing a handle shaft 178, a first stem 180, a second stem 182, and a hand grip 176. FIG. 17*b* depicts a side view of the pump handle 110 of the present invention. Turning to FIG. 18*a*, there is shown a top view of the top foot valve plate 154. FIG. 18*b* depicts a top view of the bottom foot valve plate 155. Turning now to FIG. 19, there is shown a cross-section view of the foot valve 184. Turning to FIG. 20, there is shown a top view of the foot valve 184. FIGS. 19 and 20 depict the top foot valve plate 154, the bottom foot valve plate 155, a valve rod 173, a valve washer 179, a foot valve pipe 177, an inner wire 150, and an outer wire 152. Turning now to FIG. 21, there is shown a side view of the handle 110 assembly of the present invention.

2. Advantages

The present solution minimizes the limitations of the prior solutions by allowing a user the present solution to:

Use his/her legs to suck water and push it above their own position;

Change the valves and perform other maintenance without the use of any tools or fasteners;

Pump water in a smooth, efficient flow;

Move the pump easily for security or use in multiple locations;

Adjust the position of the handle for maximum comfort; and

Provide maximum power to the pump via the contoured footpads.

Having now described at least one embodiment of the present invention, it should be apparent to those skilled in the art that the foregoing is illustrative only and not limiting, having been presented by way of example only. All the features disclosed herein (including any accompanying drawings) may be replaced by alternative features serving the same purpose, and equivalents or similar purpose, unless expressly stated otherwise. Therefore, numerous other embodiments of the modifications thereof are contemplated as falling within the scope of the present invention. Hence, use of absolute terms, such as, for example, "will not," "will," "shall," "shall not," "must," and "must not," are not meant to limit the present invention to the exemplary embodiments disclosed herein.

What is claimed:

1. A pumping apparatus to be powered by a single human operator, comprising:

a frame;

a two-chambered valve box connected to said frame, said valve box having an inlet chamber and an outlet chamber;

a vertically mounted cylinder connected to said frame above the valve box, said cylinder having a fastener-less pump valve assembly having inlet and outlet valves;

a dual-action suction and pressure piston operatively connected to said frame to move up and down inside said cylinder;

a transverse see-saw-style rocker having first and second foot pads, said rocker connected to said frame and operatively connected to said dual-action suction and pressure piston, said rocker to operate said piston when said human operator stands with one foot on each foot pad and shifts said operator's weight from said first to said second pad in a see-saw like manner;

a surge chamber operatively connected to said frame and associated with said inlet chamber to regulate smooth water flow;

a foot valve assembly having an inlet valve;

said outlet valve of said pump valve assembly comprising:

a valve plate comprising a first aperture and a plurality of second apertures being smaller than said first aperture;

a small diameter solid shaft mounted from inside of said valve box in a vertical position such that said shaft's center is centered to said first aperture;

a first rigid washer mounted on said central vertical shaft and positioned parallel to and slightly below said valve plate and centered to said first aperture to create an annular gap between said first rigid washer and said first aperture;

a concave upward rigid washer also mounted on said vertical shaft having an outside diameter smaller than said first aperture's diameter and larger than said first rigid washer's outside diameter; and a valve seal with a central hole of a diameter equal to the vertical shaft diameter;

wherein said valve seal is inserted through said annular gap and said valve seal central hole is stretched over said first rigid washer such that said valve seal sits between said first and concave upward rigid washers so that said concave upward rigid washer tensions said valve seal against said valve plate to cover said plurality of second apertures thus closing said valve assembly in its natural position; and wherein said outlet valve of said pump valve assembly functions as said foot valve's inlet valve.

2. The pumping apparatus of claim 1 further comprising a multi-position handle connected to said frame.

3. The pumping apparatus of claim 1 wherein said first and second foot pads are contoured.

4. The pumping apparatus of claim 1 wherein said valve plate is flat.

5. The pumping apparatus of claim 1 wherein said plurality of second apertures are situated around said first aperture.

6. The pumping apparatus of claim 1 wherein said valve seal is made from a stretchable material.

7. The pumping apparatus of claim 6 wherein said stretchable material is rubber.

8. The pumping apparatus of claim 1 wherein said frame is portable.

9. A fastener-less pump valve assembly to be used in a pumping apparatus, said pumping apparatus including a foot valve with an inlet valve, said valve assembly comprising:

an outlet valve comprising:

a valve plate comprising a first aperture and a plurality of second apertures being smaller than said first aperture;

a small diameter solid shaft mounted from inside of said valve box in a vertical position such that said shaft's center is centered to said first aperture;

a first rigid washer mounted on said central vertical shaft and positioned parallel to and slightly below said valve plate and centered to said first aperture to create an annular gap between said first rigid washer and said first aperture;

a concave upward rigid washer also mounted on said vertical shaft having an outside diameter smaller than said first aperture's diameter and larger than said first rigid washer's outside diameter; and a valve seal with a central hole of a diameter equal to the vertical shaft diameter;

wherein said valve seal is inserted through said annular gap and said valve seal central hole is stretched over said first rigid washer such that said valve seal sits between said first and concave upward rigid washers so that said concave upward rigid washer tensions said valve seal against said valve plate to cover said plurality of second apertures thus closing said valve assembly in its natural position; and wherein said outlet valve of said pump valve assembly also functions as said foot valve's inlet valve.

10. The pumping apparatus of claim 9 wherein said valve plate is flat.

11. The pumping apparatus of claim 9 wherein said plurality of second apertures are situated around said first aperture.

12. The pumping apparatus of claim 9 wherein said valve seal is made from a stretchable material.

13. The pumping apparatus of claim 12 wherein said stretchable material is rubber.

* * * * *